US007544882B2

(12) United States Patent
Satou

(10) Patent No.: US 7,544,882 B2
(45) Date of Patent: Jun. 9, 2009

(54) WAVEFORM GENERATING APPARATUS AND WAVEFORM GENERATING PROGRAM

(75) Inventor: Hiroki Satou, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 117 days.

(21) Appl. No.: 11/512,811

(22) Filed: Aug. 30, 2006

(65) Prior Publication Data

US 2007/0056432 A1 Mar. 15, 2007

(30) Foreign Application Priority Data

Sep. 14, 2005 (JP) ..... 2005-266594

(51) Int. Cl.
*G10H 7/00* (2006.01)

(52) U.S. Cl. ..... 84/622; 84/625

(58) Field of Classification Search ..... 84/622–625, 84/659, 660

See application file for complete search history.

(56) References Cited

U.S. PATENT DOCUMENTS 4,423,655 A * 1/1984 Turner ..... 84/620
4,617,851 A * 10/1986 Sato ..... 84/622
5,044,251 A * 9/1991 Matsuda et al. ..... 84/615
5,177,314 A * 1/1993 Matsuda et al. ..... 84/615
5,319,151 A * 6/1994 Shiba et al. ..... 84/603
5,357,048 A * 10/1994 Sgroi ..... 84/645
5,414,209 A * 5/1995 Morita ..... 84/615
5,541,360 A * 7/1996 Kaneko ..... 84/660
5,604,324 A * 2/1997 Kubota et al. ..... 84/622
5,625,158 A * 4/1997 Ichiki ..... 84/603
5,644,098 A * 7/1997 Jenkins et al. ..... 84/624
5,665,929 A * 9/1997 Dong et al. ..... 84/624
5,698,805 A * 12/1997 Thompson et al. ..... 84/615
5,726,371 A * 3/1998 Shiba et al. ..... 84/603
6,100,461 A * 8/2000 Hewitt ..... 84/603
6,849,795 B2 * 2/2005 Ludwig ..... 84/661
6,953,887 B2 * 10/2005 Nagashima et al. ..... 84/645
7,081,582 B2 * 7/2006 Basu ..... 84/625
7,176,373 B1 * 2/2007 Longo ..... 84/626
7,189,911 B2 * 3/2007 Isozaki ..... 84/609
7,208,672 B2 * 4/2007 Camiel ..... 84/625
7,217,878 B2 * 5/2007 Ludwig ..... 84/609

(Continued)

FOREIGN PATENT DOCUMENTS

JP 10198378 * 5/1997

(Continued)

*Primary Examiner*—David S. Warren
(74) *Attorney, Agent, or Firm*—Frishauf, Holtz, Goodman & Chick, P.C.

(57) ABSTRACT

A correspondence relationship between virtual logical oscillators, including a master oscillator and at least one slave oscillator, provided for each sound production channel generating a musical tone waveform, and a plurality of physical oscillators for actually generating a waveform and which is associated with the logical oscillators, is stored. Then, according to a process for generating the musical tone waveform, the physical oscillator assigned to the logical oscillator of the sound production channel generating the musical tone is dynamically secured or released with reference to the stored correspondence relationship. Therefore, there is no need to synchronize and playback all waveforms that may possibly be used in the additive synthesis, regardless of whether the waveform is sounded, as is required conventionally. As a result, the waveforms can be generated without needlessly wasting the sound production channel.

7 Claims, 26 Drawing Sheets

U.S. PATENT DOCUMENTS

| | | | | |
|---|---|---|---|---|
| 7,220,911 | B2 * | 5/2007 | Basu | 84/625 |
| 7,309,828 | B2 * | 12/2007 | Ludwig | 84/622 |
| 7,309,829 | B1 * | 12/2007 | Ludwig | 84/622 |
| 2002/0189426 | A1 * | 12/2002 | Hirade et al. | 84/603 |
| 2003/0121401 | A1 * | 7/2003 | Ito | 84/625 |
| 2004/0094021 | A1 * | 5/2004 | Ludwig | 84/625 |
| 2004/0099127 | A1 * | 5/2004 | Ludwig | 84/659 |
| 2004/0159221 | A1 * | 8/2004 | Camiel | 84/660 |

FOREIGN PATENT DOCUMENTS

| | | | |
|---|---|---|---|
| JP | 2000-181459 A | | 6/2000 |
| JP | 2000181459 | * | 6/2000 |

* cited by examiner

WAVEFORM GENERATING APPARATUS AND WAVEFORM GENERATING PROGRAM

CROSS-REFERENCE TO RELATED APPLICATION

This application is based upon and claims the benefit of priority from the prior Japanese Patent Application No. 2005-266594, filed 14 Sep. 2005, the entire contents of which is incorporated herein by reference.

BACKGROUND OF THE INVENTION

1. Field of the Invention

The present invention relates to a waveform generating apparatus and a waveform generating program suitable for use in an electronic musical instrument.

2. Description of the Related Art

Conventionally, a harmonic synthesis method and an additive synthesis method are known. The harmonic synthesis method synthesizes a waveform having an arbitrary harmonic structure by overlapping a fundamental harmonic and harmonic components of the fundamental harmonic. The additive synthesis method synthesizes a desired waveform by overlapping a plurality of elementary waveforms, including various waveform cycles and waveform shapes. As an example of a waveform generating apparatus configured based on the latter additive synthesis method, an apparatus is disclosed in, for example, Japanese Laid-Open Patent Publication No. 2000-181459. The disclosed apparatus stores a plurality of elementary waveforms, including various waveform cycles and waveform shapes, in a memory in advance, and reads elementary waveforms required to synthesize a desired waveform from the memory. Then, the apparatus performs a predetermined weight multiplication on each of the read elementary waveforms, adds the weight multiplication results, and forms one waveform.

Waveform generation using the additive synthesis method has problems such as the following. For example, it is known that, when two correlated waveforms having the same pitch are overlapped, a cancellation of frequency components occurs depending on a phase difference between the two waveforms. As a result, a tone that sounds as though it has been passed through a comb filter is generated. To consistently generate such tone modifications in the same manner, a constant amount of phase difference must always be maintained between the waveforms to be overlapped. To always maintain the constant amount of phase difference between the waveforms to be overlapped, waveform starting points are required to match. Furthermore, pitch modulation by, for example, low-frequency oscillation (LFO) and pitch-bend must always be synchronized with a plurality of sound production channels and continuously provide a same modulation width.

In addition, depending on the type of synthesized waveform, synthesis of the waveform used in the additive synthesis can be started during a sound production of an entire synthesized waveform or ended during the sound production of the entire synthesized waveform.

However, it is extremely difficult to synchronize a new additive waveform with a phase of a synthesized waveform that is already being sounded. Therefore, regardless of whether the waveform will be sounded, all waveforms that may possibly be used in the additive synthesis are required to be synchronously reproduced from the start to the end of the sound production of the entire synthesized waveform. As a result, the sound production channel (oscillator) is needlessly wasted.

SUMMARY OF THE INVENTION

The present invention has been achieved in light of the foregoing issues. An object of the present invention is to provide a waveform generating apparatus and a waveform generating program that can generate waveforms without needlessly wasting sound production channels.

In accordance with an aspect of the present invention, there is provided a waveform generating apparatus comprising: a virtual logical oscillator means including a master oscillator and at least one slave oscillator, provided for each sound production channel generating a musical tone waveform; a plurality of physical oscillator means for actually generating a waveform and which is associated with the logical oscillators; a memory means for storing a correspondence relationship between the logical oscillator means and the physical oscillator means; and a dynamic assignment means for dynamically securing or releasing the physical oscillator means assigned to the logical oscillator means of the sound production channel generating the musical tone, according to a process for generating the musical tone waveform, with reference to the correspondence relationship stored in the memory means.

In accordance with another aspect of the present invention, there is provided a computer program product for a waveform generating program stored on a computer-readable medium and executed by a computer, comprising the steps of: memory process for storing a virtual logical oscillator means including a master oscillator and at least one slave oscillator, provided for each sound production channel generating a musical tone waveform, and a plurality of physical oscillator means for actually generating a waveform and which is associated with the logical oscillators; and dynamic assignment process for dynamically securing or releasing the physical oscillator means assigned to the logical oscillator means of the sound production channel generating the musical tone, according to a process for generating the musical tone waveform, with reference to the correspondence relationship stored in the memory means.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

The present invention will hereinafter be described in detail with reference to the preferred embodiments shown in the accompanying drawings.

A. Configuration

A-1. Overall Configuration

Figure 1:
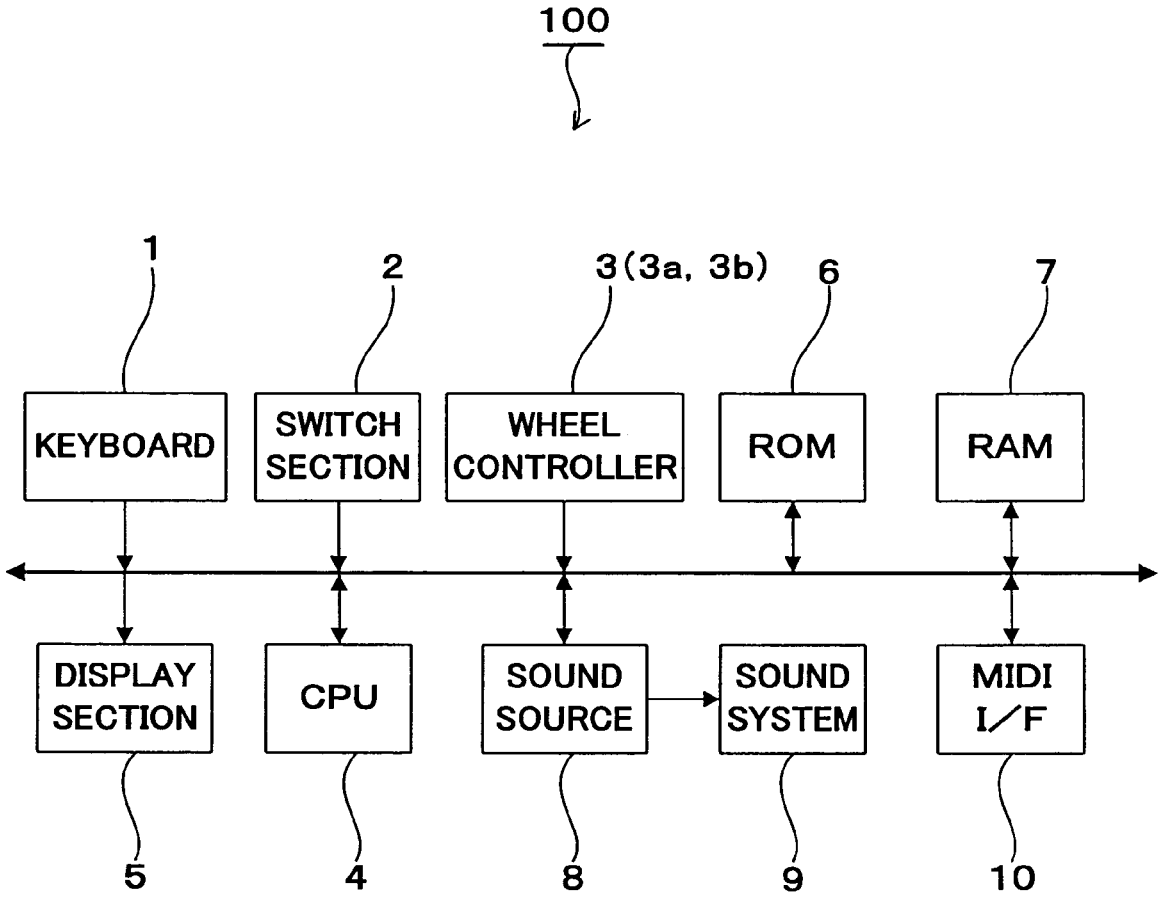
FIG. 1 is a block diagram of a configuration of an embodiment of the present invention.

FIG. 1 is a block diagram of a configuration of an electronic musical instrument 100 including a waveform generating apparatus, according to an embodiment of the present invention. The electronic musical instrument 100 includes a keyboard 1, a switch section 2, a wheel controller 3, a central processing unit (CPU) 4, a display section 5, a read-only memory (ROM) 6, a random access memory (RAM) 7, a sound source 8, a sound system 9, and a musical instrument digital interface (MIDI) interface 10.

The keyboard 1 generates performance information based on press/release key operations (performance operations). The performance information includes a key-ON/key-OFF signal, a key number, velocity, and the like. The switch section 2 includes various switches arranged and provided on a musical instrument panel. The switch 2 generates a switch event according to a type of switch that is being operated. Main switches provided in the switch section 2 are, for example, a tone selection switch, a bend width setting switch, a vibrato depth setting switch, and a low-frequency oscillation (LFO) rate setting switch. Processing operations corresponding to switch operations will be described in detail, hereafter.

The wheel controller 3 includes a bender wheel 3*a* and a modulation wheel 3*b* (not shown). The bender wheel 3*a* generates a bender wheel displacement value BV according to user operations and supplies the generated bender wheel displacement value BV to the CPU 4. The modulation wheel 3*b* generates a modulation wheel displacement value MD according to user operations and supplies the generated modulation wheel displacement value MD to the CPU 4. As explained hereafter, the displacement values BV and MD are used to variably control a pitch sounded according to a key on the keyboard 1 being pressed.

The CPU 4 sets an operation state of each section of the musical instrument, based on the switch event generated according to the switch operations in the switch section 2. The CPU 4 also generates a note-ON/note-OFF instruction depending on the performance information supplied by the keyboard 1. Then, the CPU 4 sends the generated note-ON/note-OFF instruction to the sound source 8, in addition to various parameters stored in the RAM 7, described hereafter, and enables the sound source 8 to form a musical tone. Furthermore, the CPU 4 instructs the sound source 8 to perform pitch control (pitch-bend and vibrato) according to the displacement values BV and MD supplied by the above-described wheel controller 3. The processing operations of the CPU 4 according to the summary of the present invention will be described in detail, hereafter.

The display section 5 includes a liquid-crystal display panel and a drive circuit. The display section 5 displays, for example, parameter setting states and operation states according to a display control signal supplied by the CPU 4. The ROM 6 includes a program area and a data area. The program area of the ROM 6 stores various control programs loaded into the CPU 4.

The various control programs stated herein include a main routine, a switch and wheel processing, a keyboard process, a note-ON process, a note register release process, a physical open sound control (OSC) acquiring process, an OSC parameter setting process, a physical OSC release process, a note-OFF process, a sound production timer process, an oscillator process, an envelope process, a pitch envelope process, and an accumulating process. Operations of each process will be described hereafter. The data area of the ROM 6 stores tone parameters and various after-touch tables ATTBL. Configurations of the tone parameters stored in the data area of the ROM 6 will be described hereafter.

The RAM 7 is used as a work area of the CPU 4. The RAM 7 temporarily stores various register and flag data. Configurations of the main registers stored in the work area of the RAM 7 will be described hereafter. The sound source 8 generates a musical tone waveform according to commands and parameters supplied by the CPU 4. A configuration of the sound source 8 will be described in detail, hereafter. The sound system 9 performs filtering, such as elimination of unnecessary noise from the musical tone waveform outputted from the sound source 8. Then, the sound system 9 performs level amplification on the musical tone waveform and produces sound from a speaker. The MIDI interface 10 exchanges MIDI data with an external MIDI musical instrument, under the control of the CPU 4.

A-2. Configuration of RAM 7

Next, configurations of the main registers provided in the RAM 7 will be explained, with reference to FIG. 2A and FIG. 2B to FIG. 6A and FIG. 6B. The main registers include oscillator parameter registers, schedule parameter registers, note parameter registers, physical/logical oscillator correspondence parameter registers, and performance parameter registers.

<Configuration of Oscillator Parameter Registers>

Figure 2A:
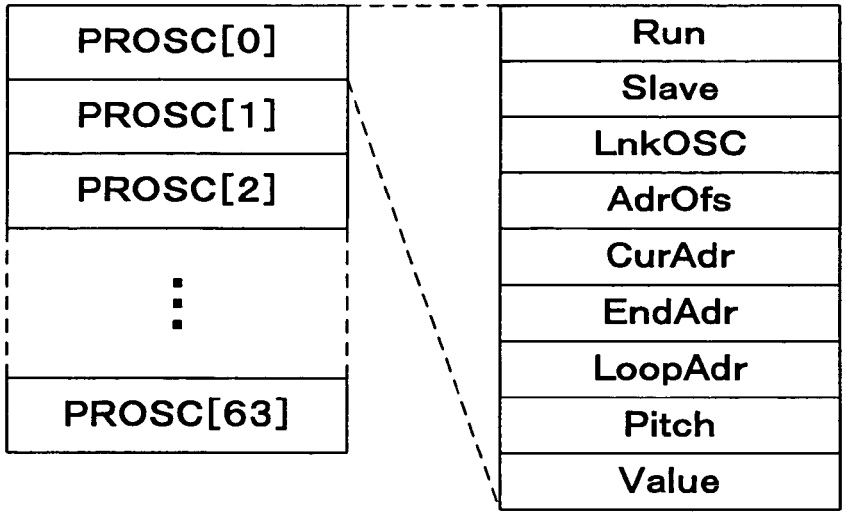
FIG. 2A and FIG. 2B are diagrams showing configurations of oscillator parameter registers PROSC[0] to PROSC[63] and schedule parameter registers.

FIG. 2A is a diagram showing a configuration of oscillator parameter registers PROSC[0] to PROSC[63]. The oscillator parameter registers PROSC[0] to PROSC[63] respectively temporarily store parameters of each of the 64 oscillators provided in the sound source 8. Oscillator parameters include a flag RUN, a flag Slave, a register LnkOSC, a register AdrOfs, a register CurAdr, a register EndEdr, a register LoopAdr, a register Pitch, and a register Value.

The flag RUN is defined as a flag that is set to "1" when the oscillator is in operation and "0" when the oscillator is not in operation. The flag Slave is defined as a flag that is set to "1" when the oscillator is used as a slave of another oscillator and "0" when the oscillator is not used as the slave. The register LnkOSC temporarily stores a master oscillator number when the flag Slave is set to "1", namely, when the oscillator is operating as the slave. The register AdrOfs stores an off-set address indicating a difference between a waveform read-out address of the slave oscillator and a waveform read-out address of the master oscillator, when the oscillator is operating as the slave.

The register CurAdr stores a current waveform read-out address. The register EndEdr stores a read-out end address. The register LoopAdr stores a start address for when the waveform is played back in a loop. The register Pitch stores a waveform read-out phase (read-out pitch) that is added to the register CurAdr at each sampling cycle, when the oscillator is operating as the master. The register Value stores a waveform output value of a corresponding oscillator.

<Configuration of Schedule Parameter Registers>

Figure 2B:
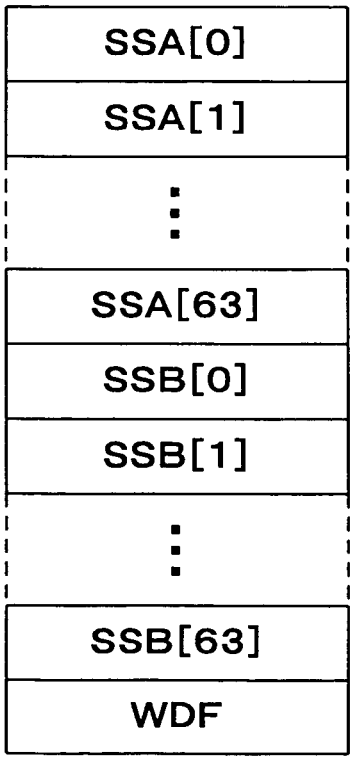

FIG. 2B is a diagram showing a configuration of the schedule parameter registers. The schedule parameter registers are largely divided into registers SSA[0] to SSA[63] and registers SSB[0] to SSB[63]. The CPU 4 writes an oscillator processing sequence in the registers SSB[0] to SSB[63]. The oscillator processing sequence is for generating waveforms by time-sharing within one sampling cycle.

A flag WDF is set to "1" when the CPU 4 completes writing the oscillator processing sequence in the registers SSB[0] to SSB[63]. When the flag WDF is set to "1", the contents of the registers SSB[0] to SSB[63] are transferred to the registers SSA[0] to SSA[63]. The sound source 8, described hereafter, generates the waveforms for each oscillator by time-sharing within one sampling cycle, according to the processing sequence transferred to the registers SSA[0] to SSA[63].

<Configuration of Note Parameter Registers>

Figure 3:
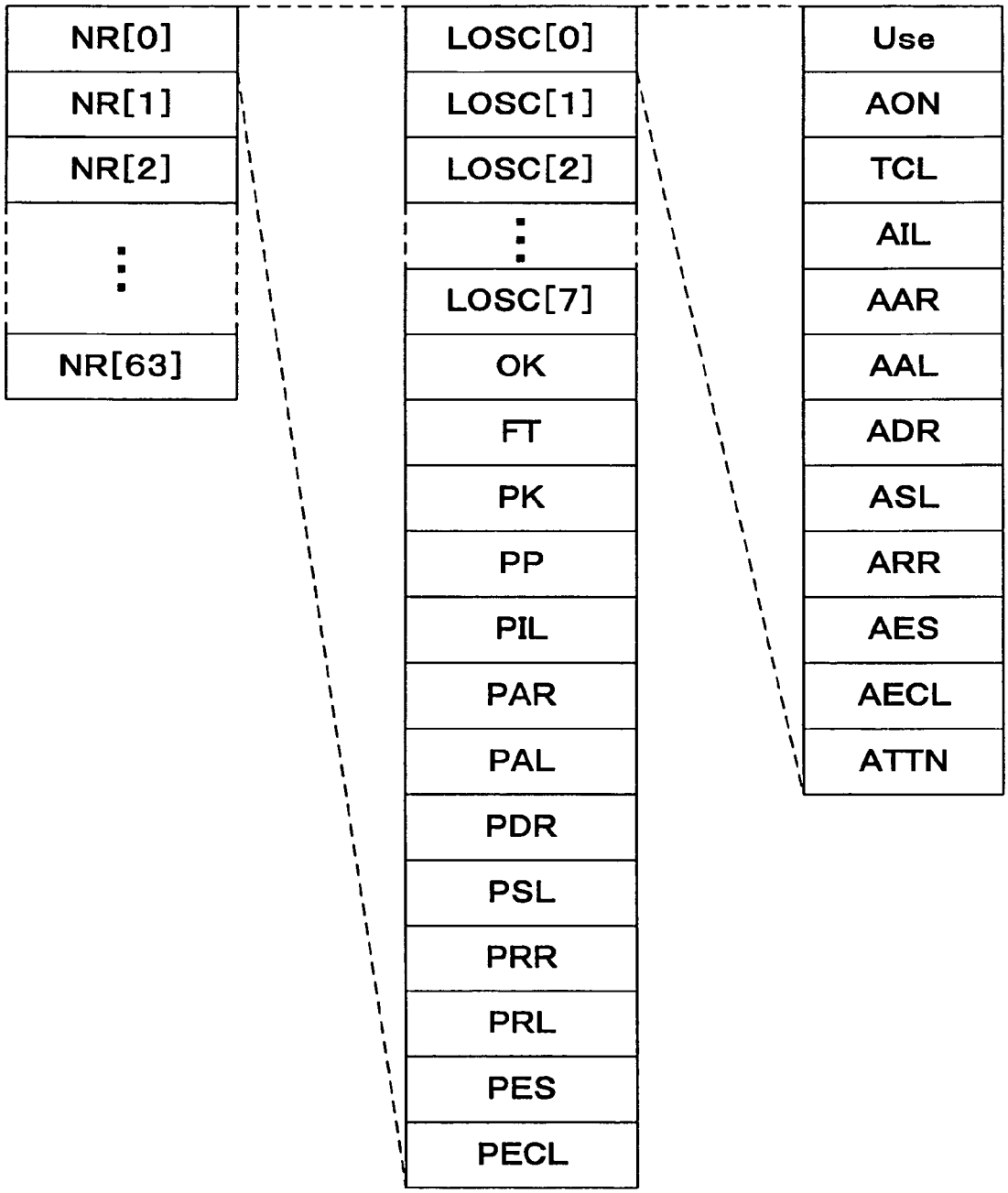
FIG. 3 is a diagram showing a configuration of note parameter registers NR[0] to NR[63]

FIG. 3 is a diagram showing a configuration of note parameter registers NR[0] to NR[63]. The note parameter registers NR[0] to NR[63] temporarily store musical tone forming parameters for each sound production channel. Note parameters provided for one sound production channel include registers LOSC[0] to LOSC[7], a register OK, a register FT, a register PK, a register PP, a register PIL, a register PAR, a register PAL, a register PDR, a register PSL, a register PRR, a register PRL, a register PES, and a register PECL.

A total of eight virtual logical oscillators can be assigned to the sound production channel forming one musical tone. The eight virtual logical oscillators include a master oscillator and a maximum of seven slave oscillators belonging to the master oscillator. In other words, one sound production channel has a maximum of eight logical oscillators. The registers LOSC[0] to LOSC[7] respectively store logical oscillator parameters. The register LOSC[0] stores the logical oscillator parameters of the master oscillator, among the logical oscillators. The registers LOSC[1] to [7] store the logical oscillator parameters of the slave oscillators. The logical oscillator parameters include a flag Use, a register AON, a register TCL, a register AIL, a register AAR, a register AAL, a register ADR, a register ASL, a register ARR, a flag AES, a register AECL, and a register ATTN.

The master oscillator indicated in the register LOSC[0] is not in use when the flag Use is set to "0". The master oscillator is in use when the flag Use is set to "1". At the same time, in the registers LOSC[1] to LOSC[7] indicating the slave oscillators, the flag Use is set to any of four states, "−1", "0", "1", and "2". When the flag Use is set to "−1", a state is indicated in which the slave oscillator is always not in use. When the flag Use is set to "0", a state is indicated in which the slave oscillator is not assigned as a physical oscillator. In addition, although the slave oscillator is not involved in the sound production process, envelope formation is advanced. The physical oscillator indicates an oscillator specified by a physical oscillator number, among the 64 oscillators provided in the sound source 8. When the flag Use is set to "1", a state is indicated in which the slave oscillator is assigned as the physical oscillator. In addition, the slave oscillator is being sounded and the envelope formation is performed. When the flag Use is set to "2", a physical oscillator assignment wait state immediately after note-ON is indicated.

The register AON stores a number of the assigned physical oscillator. When the physical oscillator is not assigned, the register AON stores "−1". The register TCL stores a volume level provided to an amplifier 84 (described hereafter) of the sound source 8. The register AIL to register ARR store envelope parameters for generating a known ADSR-type volume control envelope waveform, shown in FIG. 4.

Figure 4:
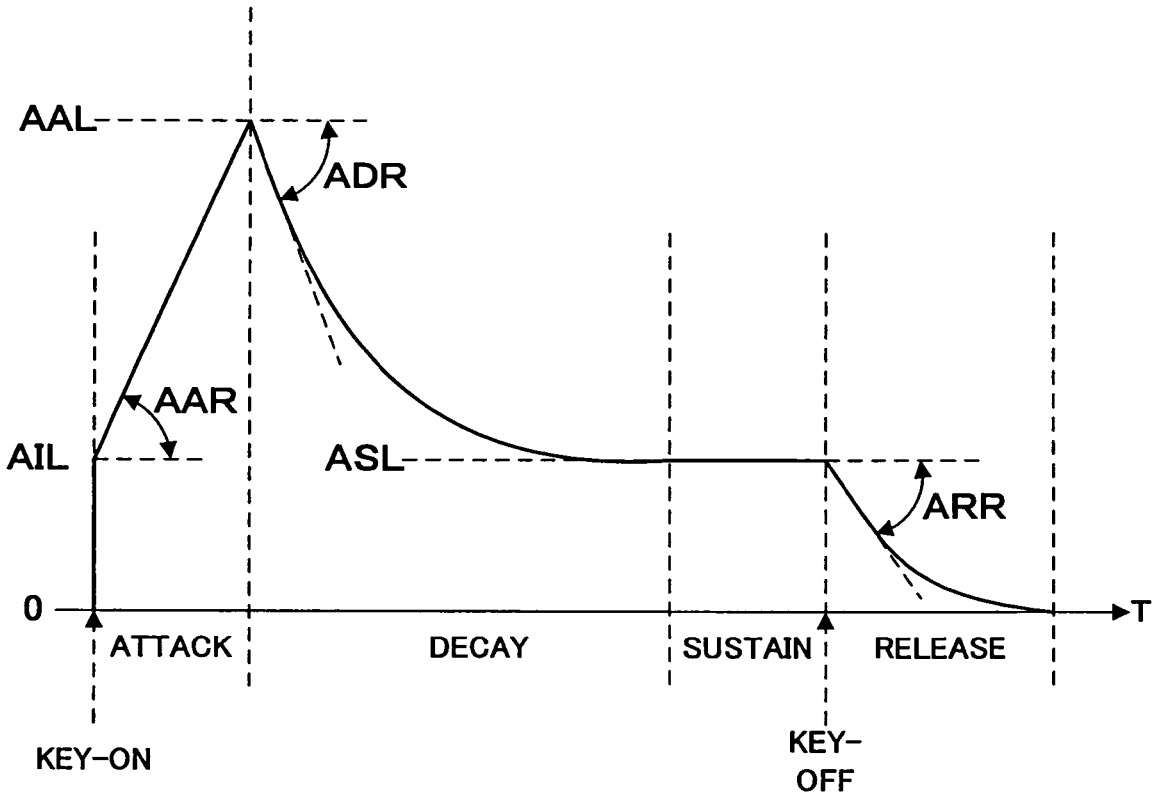
FIG. 4 is a waveform diagram for explaining a volume control envelope waveform.

In other words, as shown in FIG. 4, the register AIL stores an initial level AIL at the time of key-ON. The register AAR stores an attack rate AAR. The register AAL stores an attack level AAL. The register ADR stores a decay rate ADR. The register ASL stores a sustain level ASL. The register ARR stores a release rate ARR at the time of key-OFF.

The flag AES is defined as a flag indicating a state transition according to the progression of the volume control envelope waveform. Namely, the flag AES is set to "0" in a stop-state, "1" in an attack area, "2" in a decay area, "3" in a sustain area, and "4" in a release area. The register AECL stores an output value of the volume control envelope waveform currently generated according to each envelope parameter stored in the register AIL to register ARR, described above. The register ATTN stores a table number specifying an after-touch table to be reference, among the various after-touch tables stored in the ROM 6.

Next, the note parameters subsequent to the registers LOSC[0] to LOSC[7] will be explained. The register OK stores an original key (note number) indicating an original pitch of the waveform data read out from a waveform memory 82 of the sound source 8. The register FT stores a tuning value for fine-tuning a sound production pitch. The register PK stores a performance key (a key number of a pressed key on the keyboard 1). The register PP stores pitch displacement indicating a read-out speed during sound production. The pitch displacement stored in the register PP is calculated using a following relationship: performance key PK−original key OK+adjustment value FT/100. The unit used to express the pitch displacement is "semitone".

Figure 5:
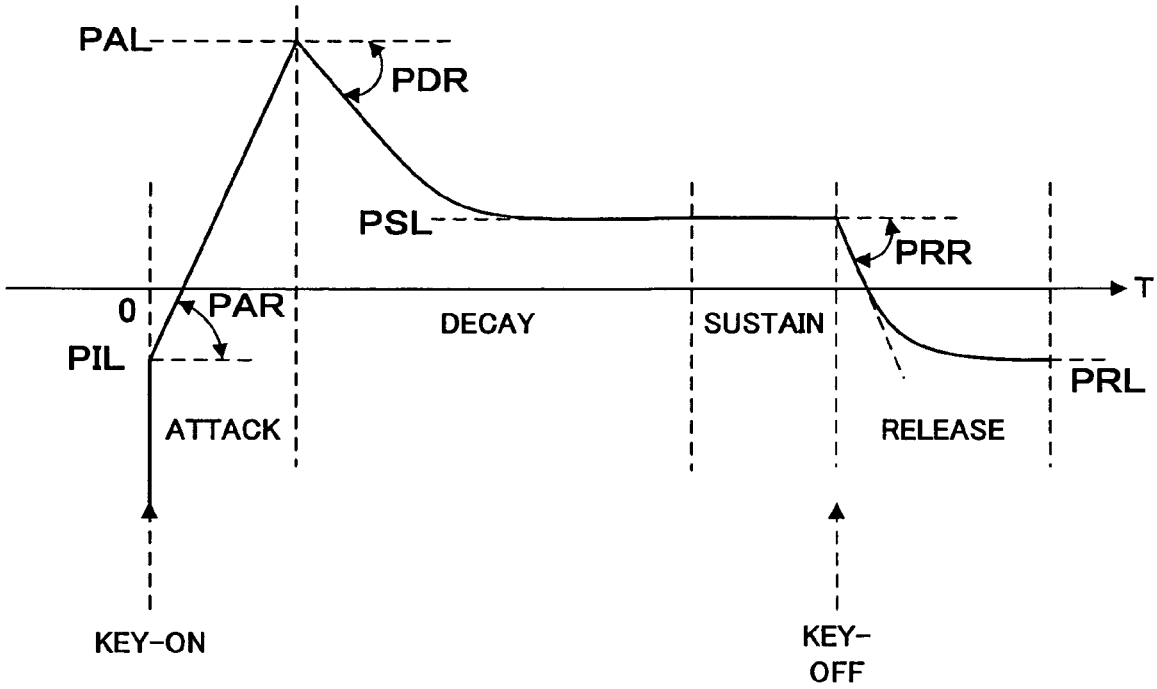
FIG. 5 is a waveform diagram for explaining a pitch control envelope waveform.

The register PIL to register PRL store envelope parameters for generating pitch control envelope waveforms, having a shape shown in FIG. 5. In other words, as shown in FIG. 5, the register PIL stores an initial level PIL at the time of key-ON. The register PAR stores an attack rate PAR. The register PAL stores an attack level PAL. The register PDR stores a decay rate PDR. The register PSL stores a sustain level PSL. The register PRR stores a release rate PRR at the time of key-OFF. The register PRL stores a release level PRL. The flag PES indicates a state transition according to the progression of the pitch control envelope waveform. In other words, the flag PES is set to "0" in the stop-state, "1" in the attack area, "2" in the decay area, "3" in the sustain area, and "4" in the release area. The register PECL stores an output value of the pitch control envelope waveform currently generated according to each envelope parameter stored in the register PIL to register PRL, described above.

<Configuration of Physical/logical Oscillator Correspondence Parameter Registers>

Figure 6A:
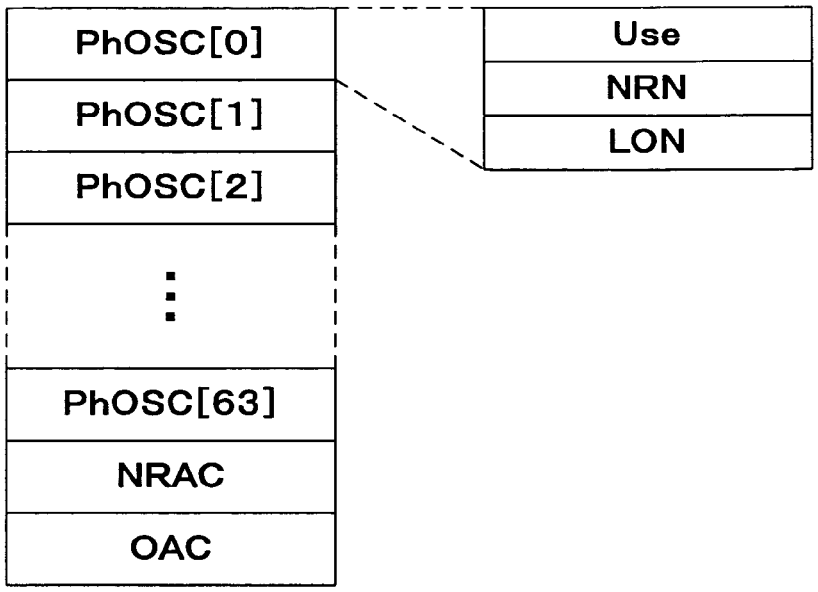
FIG. 6A and FIG. 6B are diagrams showing configurations of physical and logical oscillator correspondence parameter registers and performance parameter registers.

FIG. 6A is a diagram showing a configuration of the physical/logical oscillator correspondence parameter registers. The physical/logical oscillator correspondence parameter registers include registers PhOSC[0] to PhOSC[63], a register NRAC, and a register OAC. The registers PhOSC[0] to PhOSC[63] store assigner parameters for each physical oscillator. The assigner parameters include a flag Use, a register NRN, and a register LON.

The flag Use is defined as a flag indicating whether the physical oscillator is in use. When the flag Use is set to "0", the physical oscillator is not in use. When the flag Use is set to "1", the physical oscillator is in use. The register NRN stores a number of a note parameter register NR[n] that is using the physical oscillator. The register LON stores a logical oscillator number. The logical oscillator number is defined as a number specifying a logical oscillator (LOSC[0] to LOSC [7]) assigned to a note parameter register NR[NRN] (see FIG. 3) corresponding to the note parameter register number NRN, above. The register NRAC and the register OAC are assign-counters. The purposes of the register NRAC and the register OAC will be described hereafter.

<Configuration of Performance Parameter Registers>

Figure 6B:
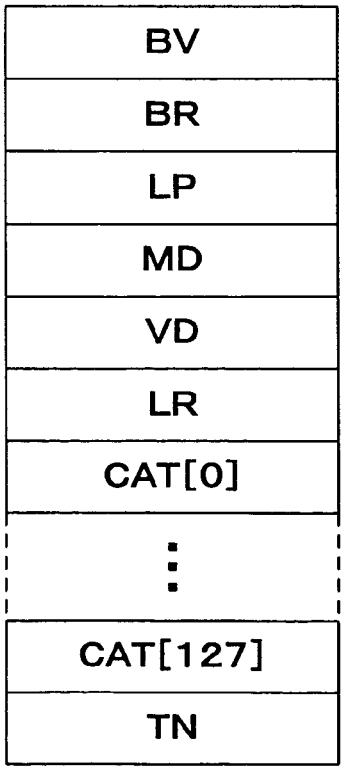

FIG. 6B is a diagram showing a configuration of the performance parameter registers. The performance parameter registers include a register BV, a register BR, a register LP, a register MD, a register VD, a register LR, registers CAT[0] to CAT[127], and a register TN. The register BV stores a bender wheel displacement amount according to a bender wheel 3*a* operation. The register BR stores a bend range setting value set by a switch operation. The register LP stores a phase angle of the LFO. The register MD stores a modulation wheel displacement amount according to a modulation wheel 3*b* operation. The register VD stores a vibrato depth setting value set by a switch operation. The register LR stores a LFO rate. The registers CAT[0] to CAT[127] store an after-touch level for each key number (or note number). The register TN stores at one number selected by a tone selection switch operation.

A-3. Configuration of Tone Parameters

Figure 7:
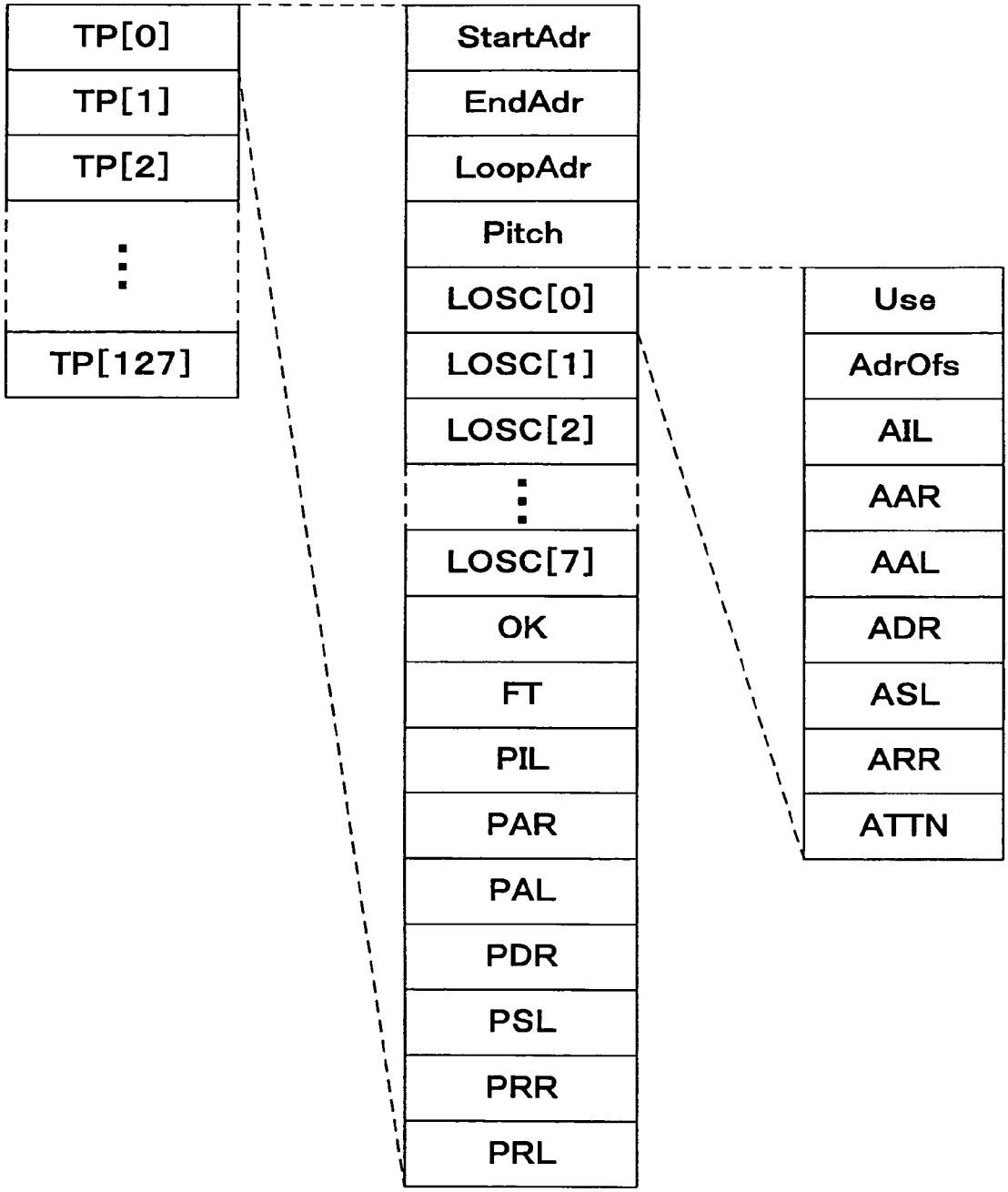
FIG. 7 is a diagram showing a configuration of tone parameters stored in a ROM 6.

Next, a configuration of the tone parameters stored in the data area of the ROM 6 will be explained, with reference to FIG. 7. In the present embodiment, the data area of the ROM 6 includes 128 types of tone parameters TP[0] to TP[127]. One tone parameter TP includes StartAdr, EndAdr, LoopAdr, Pitch, LOSC[0] to LOSC[7], OK, FT, PIL, PAR, PAL, PDR, PSL, PRR, and PRL.

The StartAdr is defined as a start address of a waveform data of a corresponding tone. The EndAdr is defined as an end address of the waveform data of the corresponding tone. The LoopAdr is defined as a loop address indicating a start address for when the waveform data is played back in a loop. The Pitch is defined as an original pitch of the waveform data of the corresponding tone. The waveform data of the corresponding tone itself is stored in the waveform memory 82 (described hereafter) of the sound source 8. Therefore, the start address StartAdr, the end address EndAdr, and the loop address LoopAdr specify address spaces within the waveform memory 82.

The LOSC[0] to LOSC[7] are defined as logical oscillator parameters assigned to the corresponding tone. The LOSC[0] indicates the parameters of the master oscillator. The LOSC [1] to LOSC[7] indicate the parameters of the slave oscillators. The logical oscillator parameters include Use, AdrOfs, AIL, AAR, AAL, ADR, ASL, ARR, and ATTN.

When Use is set to "−1", the oscillator is not in use. When Use is set to "1", the oscillator is in use. The AdrOfs is defined as an off-set address indicating the difference between the waveform read-out address of the slave oscillator and the waveform read-out address of the master oscillator, when the oscillator is operating as the slave. The AIL to ARR are defined as the envelope parameters of the volume control envelope waveform shown in FIG. 4. In other words, as shown in FIG. 4, the AIL is the initial level. The ARR is the attack rate. The AAL is the attack level. The ADR is the decay rate. The ASL is the sustain level. The ARR is the release rate. The ATTN is defined as the table number specifying the after-touch table to be referenced, among the various after-touch tables stored in the ROM 6.

Next, the tone parameters subsequent to the logical oscillator parameters LOSC[0] to LOSC[7] will be explained.

OK is defined as an original key (note number) indicating the original pitch of the waveform data read out from the waveform memory 82 of the sound source 8. FT is defined as a tuning value for fine-tuning the sound production pitch. The PIL to PRL are defined as envelope parameters for the pitch control envelope waveform, having the shape shown in FIG. 5. In other words, as shown in FIG. 5, the PIL is the initial level. The PAR is the attack rate. The PAL is the attack level. The PDR is the decay rate. The PSL is the sustain level. The PRR is the release rate. The PRL is the release level.

A-4. Configuration of Sound Source 8

Figure 8:
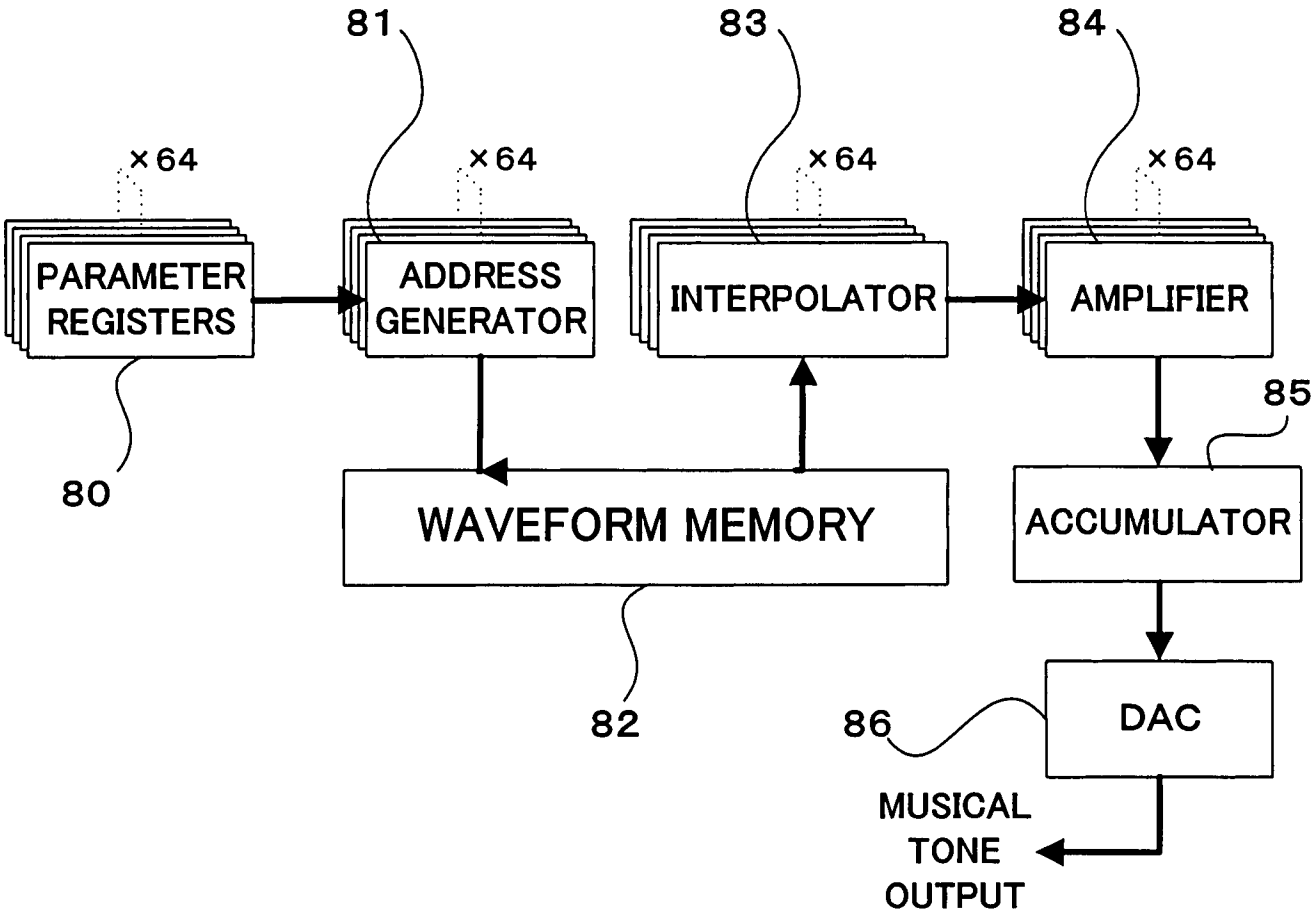
FIG. 8 is a block diagram showing a configuration of a sound source 8.

Next, a configuration of the sound source 8 will be explained, with reference to FIG. 8. The sound source 8 includes a known digital signal processing (DSP). Therefore, FIG. 8 shows a functional block diagram in which each function of a micro-program executed in the DSP is expressed as a hardware image. The sound source 8 includes an address generator 81, the waveform memory 82, an interpolator 83, an amplifier 84, an accumulator 85, and a digital/analog (D/A) converter 86.

Parameter registers 80 temporarily store parameters for each of the 64 oscillators. The parameters are provided by the CPU 4. The above-mentioned parameters include the oscillator parameter registers PROSC[0] to PROSC[63] shown in FIG. 2A, the schedule parameter registers shown in FIG. 2B, and the tone parameters shown in FIG. 7. The address generator 81 generates the waveform read-out address of each of the 64 oscillators, with reference to each parameter read out from the parameter registers 80. The waveform memory 82 stores various tone waveform data and outputs the waveform data of each oscillator according to the waveform read-out address of each oscillator provided by the address generator 81.

The interpolator 83 performs an interpolation output of the waveform data of each oscillator. The interpolation output refers to a process for interpolating waveform data (waveform value) read out in correspondence with an integer section of the waveform read-out address at a decimal section of the waveform read-out address. The amplifier 84 multiples the waveform data of each oscillator with the volume control envelope waveform and performs level control. The waveform data is interpolated and outputted from the interpolator 83. The volume control envelope waveform is provided by the CPU 4. The accumulator 85 performs additive synthesis on the waveform data of each oscillator that has been level-controlled by the amplifier 84 and forms musical tone waveform data. The D/A converter 86 performs a D/A conversion on the musical tone waveform data outputted from the accumulator 85 and converts the musical tone waveform data into a musical tone waveform signal. Then, the D/A converter 86 outputs the converted signal.

B. Operations

Next, operations of the embodiment will be explained. In the above-described configuration, the sound source 8 is expressed as the hardware image of hardware that forms musical tones according to instructions from the CPU 4. However, in actuality, a DSP program process performed by the sound source 8 and a program process performed by the CPU 4 mutually cooperate to form the musical tone. Therefore, in the present explanation of the operation, the CPU 4 is expressed as a main operating body that also performs the DSP program processing of the sound source 8, to simplify the explanation.

Hereafter, respective operations of the main routine, the switch and wheel process, the keyboard process, the note-ON process, the note register release process, the physical OSC acquiring process, the physical OSC release process, the OSC parameter setting process, the note-OFF process, the sound production timer process, the oscillator process, the envelope process, the pitch-envelope process, and the accumulating process performed by the CPU 4 will be described, with reference to FIG. 9 to FIG. 26.

B-1. Main Routine Operation

Figure 9:
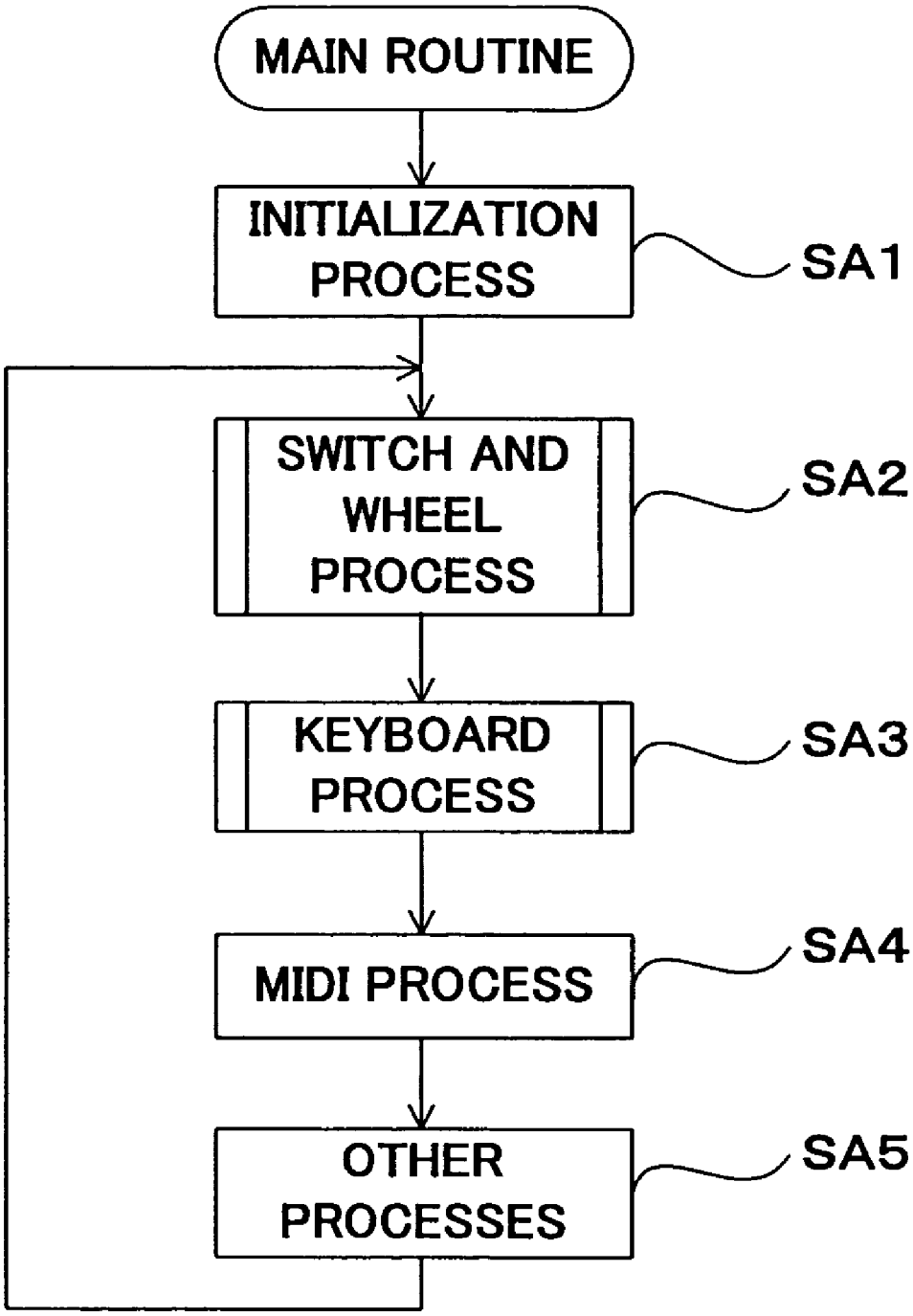
FIG. 9 is a flowchart showing main routine operations.

When the electronic musical instrument 100 according to the configuration above is turned on, the CPU 4 performs the main routine shown in FIG. 9, proceeds to Step SA1, and performs initialization. In the initialization, the CPU 4 reset various registers and flags stored in the RAM 7, sets initial values, and the like. Then, at Step SA2, the CPU 4 performs the switch and wheel process corresponding to the switch operation of the switch section 2 and the operation of the wheel controller 3.

Next, at Step SA3, the CPU 4 performs the keyboard process for instructing the sound source 8 to produce sound or attenuate sound, according to the press/release key operations of the keyboard 1. At Step SA4, the CPU 4 performs the MIDI process for instructing the sound source 8 to produce sound or attenuate sound, as in the keyboard process, according to a note-ON/note-OFF event inputted from the external MIDI instrument, via the MIDI interface 10. Next, at Step SA5 performs other processes, such as displaying the operation state set by a user in the display section 5, and returns to Step SA2. Subsequently, the CPU 4 repeats Steps SA2 to SA5 until the electronic musical instrument 100 is turned off.

B-2. Switch and Wheel Process Operation

Figure 10:
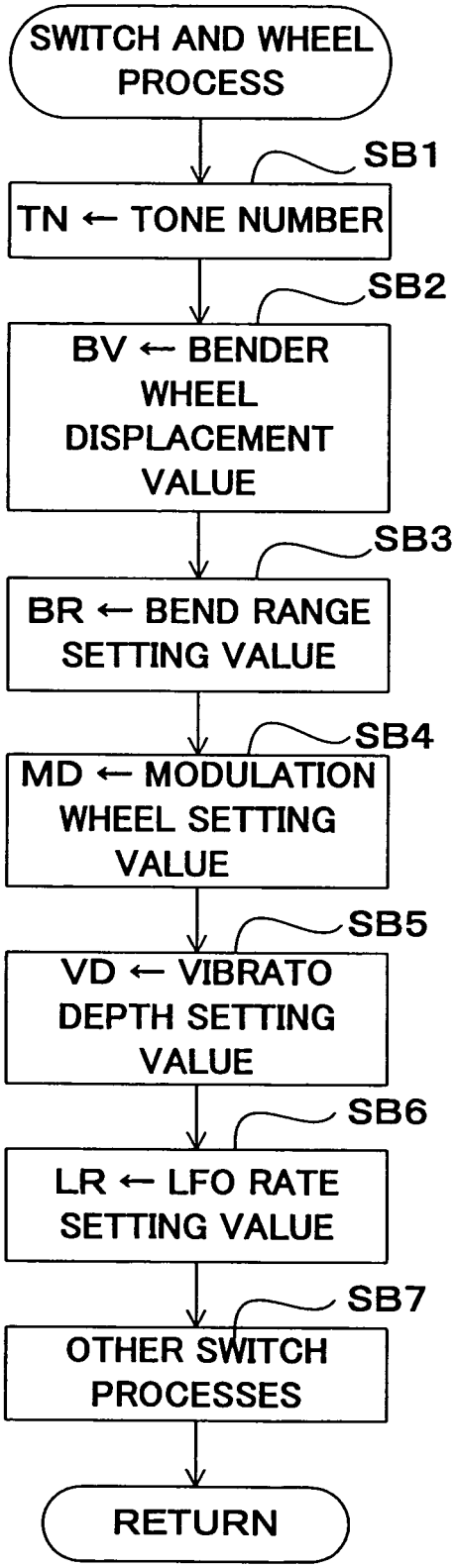
FIG. 10 is a flowchart showing switch and wheel process operations.

The operation of the switch and wheel process will be explained with reference to FIG. 10. When the present process is performed via Step SA2 of the main routine, the CPU 4 sets the parameters according to the operations of the switch section 2 and the wheel controller 3. In other words, at Step SB1, the CPU 4 stores the tone number in the register TN. The tone number is selected by the operation of the musical tone selection switch provided in the switch section 2. The register TN is provided in the performance parameter registers (see FIG. 6B), described above.

Next, at Step SB2, the CPU 4 stores the bender wheel displacement value in the register BV. The bender wheel displacement value is outputted from the bender wheel 3*a* of the wheel controller 3. The register BV is provided in the performance parameter registers (see FIG. 6B). At Step SB3, the CPU 4 stores the bend range setting value in the register BR. The bend range setting value is set by the operation of the bend width setting switch provided in the switch section 2. The register BR is provided in the performance parameter registers (see FIG. 6B). At subsequent Step SB4, the CPU 4 stores the modulation wheel setting value in the register MD. The modulation wheel setting value is outputted from the modulation wheel 3*b* of the wheel controller 3. The register MD is provided in the performance parameter registers (see FIG. 6B).

At Step SB5, the CPU 4 stores the vibrato depth setting value in the register VD. The vibrato depth setting value is set by the operation of the vibrato depth setting switch provided in the switch section 2. The register VD is provided in the performance parameter registers (see FIG. 6B). Next, at Step SB6, the CPU 4 stores the LFO rate setting value in the register LR. The LFO rate setting value is set by the operation of the LFO rate setting switch provided in the switch section 2. The register LR is provided in the performance parameter registers (see FIG. 6B). Then, at Step SB7, the CPU 4 performs processes corresponding to other switch operations and completes the present process.

B-3. Keyboard Process Operation

Figure 11:
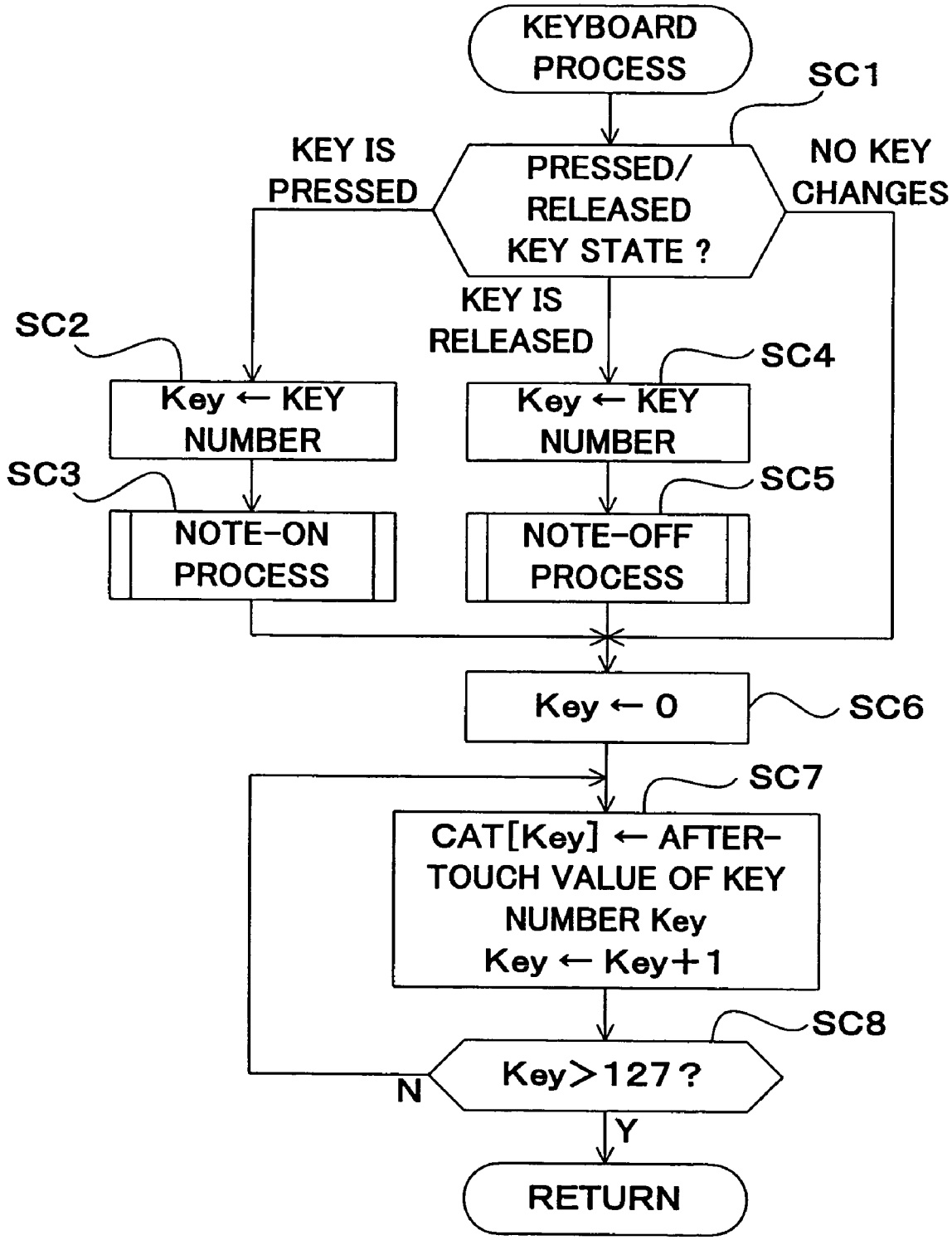
FIG. 11 is a flowchart showing keyboard process operations.

Next, the keyboard process operation will be described with reference to FIG. 11. When the present process is performed via Step SA3 of the main routine (see FIG. 9), the CPU 4 proceeds to Step SC1. The CPU 4 judges the press/release key state of the keyboard 1, based on the performance information generated by the keyboard 1. When a key is pressed, the CPU 4 proceeds to Step SC2 and stores the key number of the pressed key in the register Key. After performing the note-ON process via Step SC3 (described hereafter), the CPU 4 proceeds to Step SC6. When a key is released, the CPU 4 proceeds to Step SC4 and stores the key number of the released key in the register Key. After performing the note-OFF process via Step SC5 (described hereafter), the CPU 4 proceeds to Step SC6. If the press/release key operation is not performed and no key changes are made, the CPU 4 proceeds to Step SC6.

At Step SC6, the CPU 4 temporarily resets the register Key to zero. Then, at Step SC7 to Step SC8, the CPU 4 incrementally increases the value in the register Key by steps until all keys (128 keys) on the keyboard 1, permitted within a format, are scanned. At the same time, the CPU 4 stores an after-touch value in the register CAT[Key] within the performance registers (see FIG. 6). The after-touch value is that of the key number specified by the value in the register Key. Then, the CPU 4 completes the present process. When the key number Key corresponds to a key that actually does not physically exist on the keyboard 1, "0" is stored in the corresponding register CAT[Key].

B-4. Note-ON Process Operation

Figure 12:
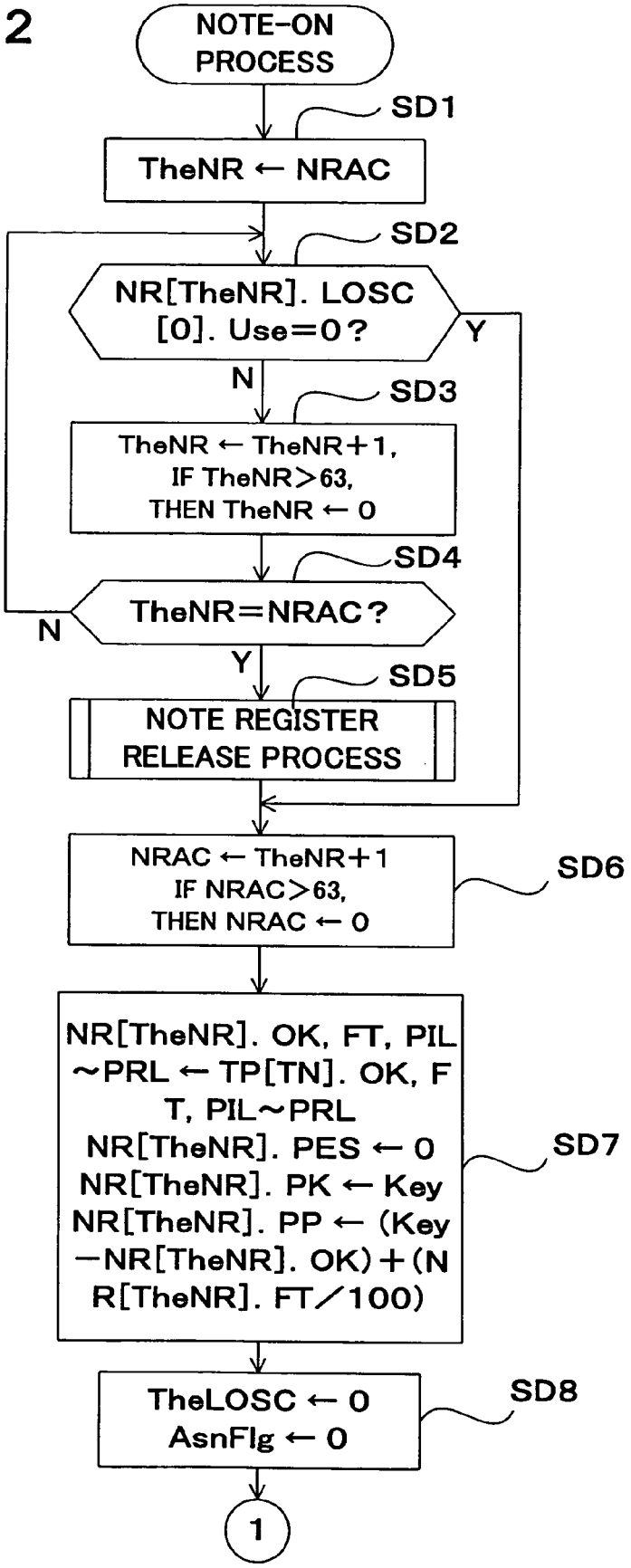
FIG. 12 is a flowchart showing note-ON process operations.

Next, the note-ON process operation will be described with reference to FIG. 12 to FIG. 13. When the present process is executed via Step SC3 of the keyboard process (see FIG. 11), the CPU 4 proceeds to Step SD1. The CP 4 sets the value of the register NRAC in a register TheNR. The register NRAC is defined as a counter in which a next channel number is set, every time a sound production assignment is performed on the sound production channels of the 64 channels. The value in the register NRAC circulates within a range of "0" to "63". Therefore, at Step SD1, the CPU 4 sets the value of the register NRAC in the register TheNR as an initial value of the sound production channel (equivalent to the note parameter register NR) performing the next sound production assignment. Hereinafter, the value stored in the register TheNR is referred to as a note parameter register number TheNR.

At Step SD2, the CPU 4 judges whether the flag Use of the master oscillator assigned to the note parameter register NR[TheNR] is not in use (NR[TheNR].LOSC[0].Use). The note parameter register NR[TheNR] is specified by the note parameter register number TheNR. When in use (NR [TheNR].LOSC[0].Use=1), the judgment result is "NO", and the CPU 4 proceeds to Step SD3. At Step SD3, the CPU 4 incrementally increases the note parameter register number TheNR by steps. When the incremented note parameter register number TheNR exceeds "63", the CPU 4 returns the incremented note parameter register number TheNR to "0". Next, at Step SD4, the CPU 4 judges whether the incremented note parameter register number TheNR matches the value in the register NRAC. In other words, The CPU 4 judges whether one round has been made. When one round has not been made, the judgment result is "NO" and the CPU 4 returns to Step SD2.

In this way, at Steps SD2 to SD4, the CPU 4 incrementally increases the note parameter register number TheNR until one round is made and the value returns to the value in the register NRAC. In addition, the CPU 4 finds a master oscillator that is not in use (NR[TheNR].LOSC[0].Use=0) from the note parameter register NR[TheNR]. When the master oscillator that is not in use is found during the process, the judgment result at Step SD2 is "YES", and the CPU 4 proceeds to Step SD6, described hereafter. On the other hand, when the master oscillator that is not in use is not found and the note parameter register number TheNR makes one round and the value returns to the value in the register NRAC, the judgment result at Step SD4 is "YES" and the CPU 4 proceeds to Step SD5.

At Step SD5, as described hereafter, the CPU 4 stops the sound production of all physical oscillators associated with the logical oscillators (the master oscillator and slave oscillators) assigned to the note parameter register NR[TheNR] specified by the note parameter register number TheNR. Then, the CPU performs the note register release process for setting the master oscillator assigned to the note parameter register NR[TheNR] (NR[TheNR].LOSC[0].Use) to be not in use. The note parameter register NR[TheNR] is specified by the note parameter register number TheNR. Next, at Step SD6, the CPU 4 stores the note parameter register number TheNR that has been incrementally increased by steps in the register NRAC. However, when the incremented note parameter register number TheNR exceeds "63", the CPU 4 resets the register NRAC to zero.

At Step SD7, the CPU 4 reads out the original key OK, the adjustment value FT, and the envelope parameters of the pitch control envelope waveform (the initial level PIL, the attack rate PAR, the attack level PAL, the decay rate PDR, the sustain level PSL, the release rate PRR, and the release level PRL), among the tone parameters TP[TN] (see FIG. 7), from the data area of the ROM 6. The original key OK indicates the original pitch of the waveform data read out from the waveform memory 82 of the sound source 8. The tuning value FT fine-tunes the sound production pitch. The tone parameters TP[TN] are specified by the tone number (hereinafter, referred to as tone number TN) stored in the register TN, according to the tone selection switch operations. The CPU 4 respectively stores the original key OK, the adjustment value FT, and the envelope parameters in the register OK, the register FT, the register PIL, the register PAR, the register PAL, the register PDR, the register PSL, the register PRR, and the register PRL, within the note parameter register NR[TheNR] specified by the note parameter register number TheNR.

In addition, at Step SD7, the CPU 4 sets the flag PES in the note parameter register NR[TheNR] to "0". The flag PES indicates the state transition according to the progression of the pitch control envelope waveform. "0" indicates the stopped state. The note parameter register NR[TheNR] is specified by the note parameter register number TheNR. Furthermore, at Step SD7, the CPU 4 stores the key number Key of the pressed key on the keyboard 1 in the register PK, within the note parameter register NR[TheNR] specified by the note parameter register number TheNR. The key number Key is stored as the performance key.

Still further, at Step SD7, the CPU 4 stores the pitch displacement in the register PP, within the note register NR[TheNR] specified by the note parameter register number TheNR The pitch displacement indicates the read-out speed during sound production. The pitch displacement stored in the register PP is calculated by (Key-NR[TheNR].OK)+(NR [TheNR].FT/100). In other words, the original key OK copied from the ROM 6 in correspondence with a selected tone is subtracted from the key number Key of the pressed key. Then, the tuning value FT copied from the ROM 6 in correspondence with the selected tone, divided by 100, is added to the subtraction result. As a result, the pitch displacement PP, expressed in "semitone" units, is calculated. Next, at Step SD8, the CPU 4 stores "0" as a logical oscillator number TheLOSC specifying the logical oscillator and sets the physical oscillator acquiring flag AsnFlg to "0".

Figure 13:
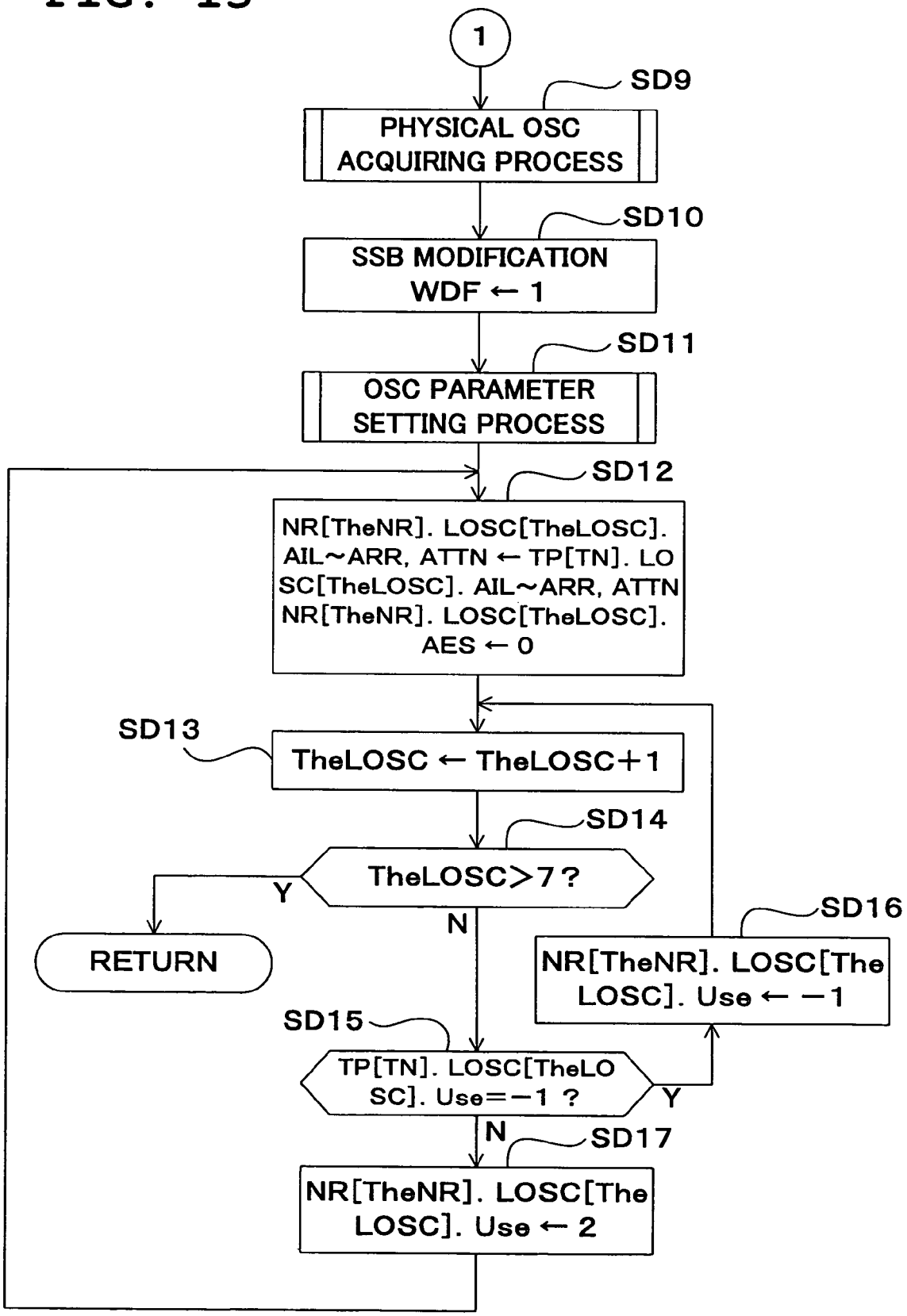
FIG. 13 is a flowchart showing note-ON process operations.

Then, the CPU 4 proceeds to Step SD9, shown in FIG. 13, and performs the physical OSC acquiring process. As described hereafter, in the physical OSC acquiring process performed within the note-ON process (the physical oscillator acquiring flag AsnFlg is set to "0"), first, if there is a physical oscillator that is not in use, the physical oscillator is acquired as a physical oscillator that is a subject of the sound production assignment. At the same time, if there is no physical oscillator that is not in use, the CPU 4 finds and selects a slave oscillator that is in use. The CPU 4 stops the sound production of the physical oscillator associated with the slave oscillator and temporarily sets the slave oscillator to not be in use. Then, the physical oscillator is acquired as the physical oscillator that is the subject of the sound production assignment. Furthermore, if no slave oscillator is in use, the CPU 4 selects a master oscillator that is in use. The CPU 4 stops the sound production of the physical oscillator associated with the master oscillator and temporarily sets the master oscillator to not be in use. Then, the physical oscillator is acquired as the physical oscillator that is the subject of the sound production assignment. In other words, the physical oscillator that is the subject of the sound production assignment of the master oscillator (logical oscillator number TheLOSC=0) is always acquired.

Next, at Step SD10, an association between the physical oscillator and the logical oscillator changes due to the sound production assignment at Step SD9. In accompaniment with the change, the CPU 4 updates the contents of the registers SSB[0] to SSB[63] (see FIG. 2B) and sets "1" in the flag WDF to indicate update completion. The registers SSB[0] to SSB [63] hold the oscillator processing sequence for generating waveforms by time-sharing within one sampling cycle. When the flag WDF is set to "1", the contents of the registers SSB[0] to SSB[63] are transferred to the registers SSA[0] to SSA[63] of an A buffer. As a result, by the sound production timer process described hereafter (see FIG. 20), the waveform is generated for each oscillator by time-sharing within one sampling cycle according to the processing sequence stored in the registers SSA[0] to SSA[63].

Next, at Step SD11, the CPU 4 performs the OSC parameter setting process. In the OSC parameter setting process that is run during the note-ON process, the CPU 4 sets a waveform generation mode of the physical oscillator operating as the master oscillator, as described hereafter. Then, at Step SD12, the CPU 4 reads out the initial level AIL, the attack rate AAR, the attack level AAL, the decay rate ADR, the sustain level ASL, and the release rate ARR, within the logical oscillator parameters LOSC[TheLOSC], from the ROM 6. The logical oscillator parameters LOSC[TheLOSC] are specified by the logical oscillator number TheLOSC. The logical oscillator parameters LOSC[TheLOSC] are provided within the tone parameters TP[TN], is specified by the tone number TN. The CPU 4 stores the envelope parameters of the volume control envelope waveform (see FIG. 4) in the register AIL to register ARR within the register LOSC[TheLOSC], specified by the logical oscillator number TheLOSC. The register LOSC [TheLOSC] is provided within the note parameter register NR[TheNR], specified by the note parameter register number TheNR.

In addition, at Step SD12, the CPU 4 stores the after-touch table number ATTN, within the logical oscillator parameters LOSC[TheLOSC] specified by the logical oscillator number TheLOSC, in the register ATTN. The logical oscillator parameters LOSC[TheLOSC] are provided within the tone parameters TP[TN], specified by the tone number TN. The register ATTN is provided within the register LOSC[TheLOSC] specified by the logical oscillator number TheLOSC. The register LOSC[TheLOSC] is provided within the note parameter register NR[TheNR] specified by the note parameter register number TheNR.

Furthermore, at Step SD12, the CPU 4 sets the flag AES, within the register LOSC[TheLOSC] specified by the logical oscillator number The LOSC, to "0". "0" indicates that the volume control envelope waveform is in the stopped-state. The register LOSC[TheLOSC] is provided within the note parameter register NR[TheNR] specified by the note parameter register number TheNR.

Then, at Step SD13, the CPU 4 incrementally increases the logical oscillator number TheLOSC by steps. At the subsequent Step SD14, the CPU 4 judges whether the incremented logical oscillator number TheLOSC exceeds "7". When the logical oscillator number TheLOSC does not exceed "7", the judgment result is "NO", and the CPU 4 proceeds to Step SD15. At Step SD15, the CPU 4 judges whether the flag Use (TP[TN].LOSC[TheLOSC].Use), within the logical oscillator parameters LOSC[TheLOSC] specified by the logical oscillator number TheLOSC, is "−1". The logical oscillator parameters LOSC[TheLOSC] are provided within the tone parameters TP[TN] specified by the tone number TN. In other words, the CPU4 judges whether the logical oscillator specified by the logical oscillator number TheLOSC is not in use.

When the logical oscillator specified by the logical oscillator number TheLOSC is not in use, the judgment result is "YES", and the CPU 4 proceeds to Step SD16. At Step SD16, the CPU4 sets the flag Use (NR[TheNR].LOSC[TheLOSC].Use), within the register LOSC[TheLOSC] specified by the logical oscillator number TheLOSC, to "−1". "1" indicates that the logical oscillator is not in use. The register LOSC [TheLOSC] is provided within the note parameter register NR[TheNR] specified by the note parameter register number TheNR. Then, the CPU 4 returns to Step SD13, described above, and incrementally increases the logical oscillator number TheLOSC.

At the same time, when the logical oscillator specified by the logical oscillator number TheLOSC is in use, the judgment result at Step SD15 is "NO", and the CPU 4 proceeds to Step SD17. At Step SD17, the CPU 4 sets the flag Use (NR [TheNR].LOSC[TheLOSC].Use), within the register LOSC [TheLOSC] specified by the logical oscillator number TheLOSC, to "2". "2" indicates the physical oscillator assignment wait state immediately after note-ON. The register LOSC[TheLOSC] is provided within the note parameter register NR[TheNR] specified by the note parameter register number TheNR.

Then, the CPU 4 returns to Step SD12, described above, and sets the envelope parameters of the volume control envelope waveform (see FIG. 4) in the logical oscillator of the incremented logical oscillator number TheLOSC. Subsequently, the CPU 4 repeats Steps SD12 to SD17 until the logical oscillator number TheLOSC exceeds "7". When the logical oscillator number TheLOSC exceeds "7", the judgment result at Step SD14 is "YES" and the present process is completed.

B-5. Note Register Release Process Operation

Next, the note register release process operation will be explained with reference to FIG. 14.

Figure 14:
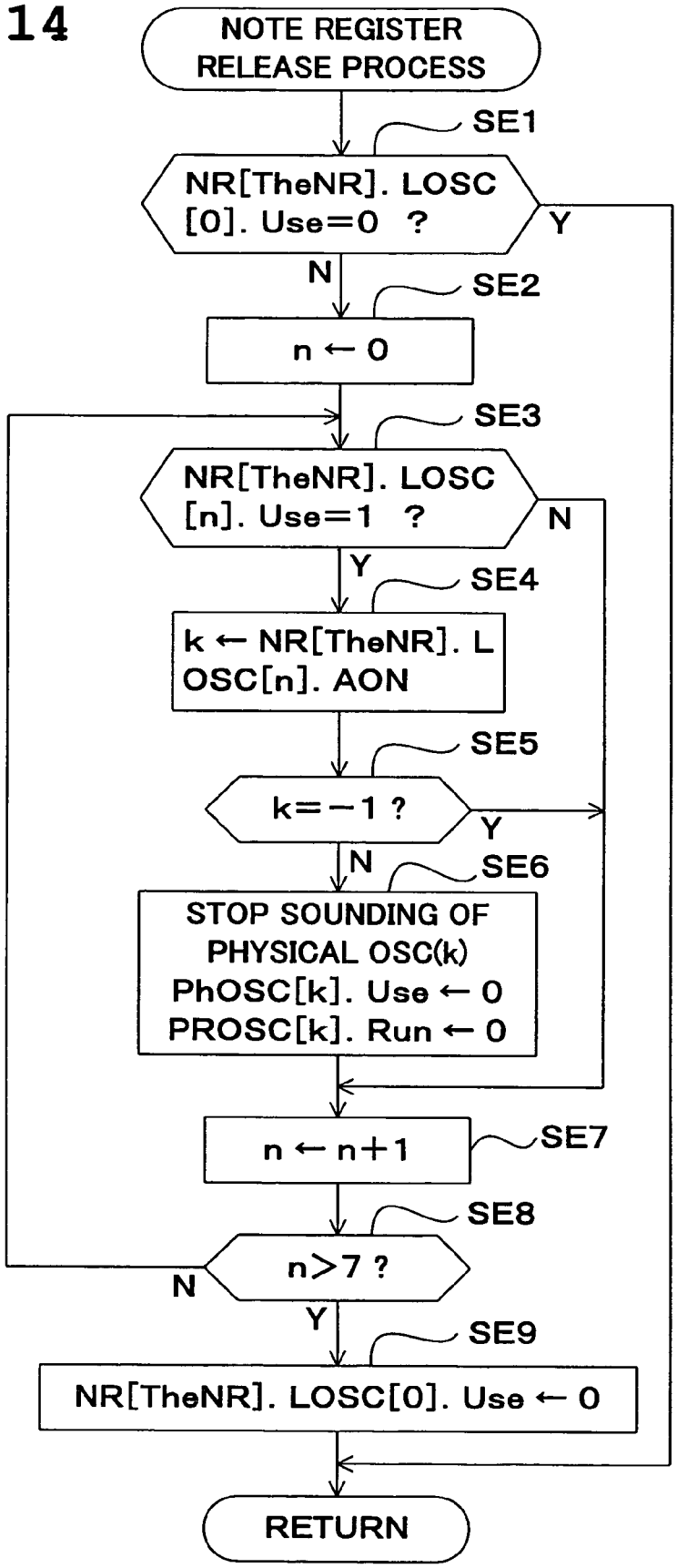
FIG. 14 is a flowchart showing note register release process operations.

When the present process is performed via Step SD5 of the note-ON process (see FIG. 12), Step SF9 of the physical OSC acquiring process described hereafter (see FIG. 16), or Step SJ5 of the note-OFF process described hereafter (see FIG. 19), the CPU 4 proceeds to Step SE1, shown in FIG. 14. At Step SE1, the CPU 4 judges whether the flag Use (NR [TheNR].LOSC[0].Use) of the master oscillator assigned to the note parameter register NR[TheNR] is not in use. The note parameter register NR[TheNR] is specified by the note parameter register number TheNR. When the flag Use is not in use (the flag Use is set to "0"), the judgment result is "YES". In this case, the note register release is not required, and therefore, the CPU 4 completes the present process without performing any operations.

At the same time, when the flag Use is in use (the flag Use is set to "1"), the judgment result at Step SE1 is "NO". The CPU 4 proceeds to Step SE2 and resets a pointer n to zero. Next, at Step SE3, the CPU 4 judges whether the flag Use (NR[TheNR].LOSC[n].Use) of the oscillator specified by the pointer n, among the oscillators assigned to the note parameter register NR[TheNR], is not in use. The note parameter register NR[TheNR] is specified by the note parameter register number TheNR.

Here, when the pointer n is "0", namely when the pointer n specifies the master oscillator, the flag Use (NR[TheNR]. LOSC[0].Use) of the master oscillator is judged to be in use (the flag Use is set to "1") at Step SE1. Therefore, the judgment result at Step SE3 is "YES", and the CPU 4 proceeds to Step SE4. At Step SE4, the CPU 4 stores a physical oscillator number (NR[TheNR].LOSC[n].AON) in the register k. The physical oscillator number (NR[TheNR].LOSC[n].AON) is associated with the oscillator specified by the pointer n, among the oscillators assigned to the note parameter register NR[TheNR] specified by the note parameter register number TheNR. Hereafter, the value in the register k is referred to as the physical oscillator number k.

At Step SE5, the CPU 4 judges whether the physical oscillator number k (NR[TheNR].LOSC[n].AON) is "−1". In other words, the CPU 4 judges whether the physical oscillator is not assigned. When the physical oscillator is not assigned, the judgment result is "YES", and the CPU 4 proceeds to Step SE7, described hereafter. On the other hand, when the physical oscillator is assigned, the judgment result at Step SE5 is "NO", and the CPU 4 proceeds to Step SE6.

At Step SE6, the CPU 4 stops the sound production of the physical oscillator (k) specified by the physical oscillator number k. In addition, the CPU 4 sets the flag Use, within the register PhOSC[k] specified by the physical oscillator number k, to "0" and sets the state in which the oscillator is not in use. The register PhOSC[k] is provided within the physical/logical oscillator correspondence parameter registers shown in FIG. 6A. Furthermore, the CPU 4 sets the flag RUN, within the oscillator parameter register PROSC[k] specified by the physical oscillator number k, to "0" and sets the state in which the oscillator is not in operation. The oscillator parameter register PROSC[k] is provided within the oscillator parameter registers shown in FIG. 2A.

Next, at Step SE7, the CPU 4 incrementally increases the pointer n by steps. At subsequent Step SE8, the CPU 4 judges whether the incremented pointer n exceeds "7". When the pointer n does not exceed "7", the judgment result is "NO", and the CPU 4 returns to Step SE3. The CPU 4 repeats Steps SE3 to SE8 until the pointer n exceeds "7". As a result, the CPU 4 stops the sound production of the physical oscillators associated with the master oscillator and the slave oscillators that are in use. The master oscillator and the slave oscillators are assigned to the note parameter register NR[TheNR] specified by the note parameter register number TheNR.

After the sound production of all physical oscillators associated with the logical oscillators (master oscillator and slave oscillators), assigned to the note parameter register NR[TheNR] specified by the note parameter register number TheNR, are stopped in this way, the judgment result at Step SE8 is "YES", and the CPU 4 proceeds to Step SE9. The CPU 4 sets the flag Use (NR[TheNR],LOSC[0].Use) of the master oscillator, assigned to the note parameter register NR[TheNR], to be not in use and completes the present process. The note parameter register NR[TheNR] is specified by the note parameter register number TheNR.

B-6. Physical OSC Acquiring Process Operation

Figure 15:
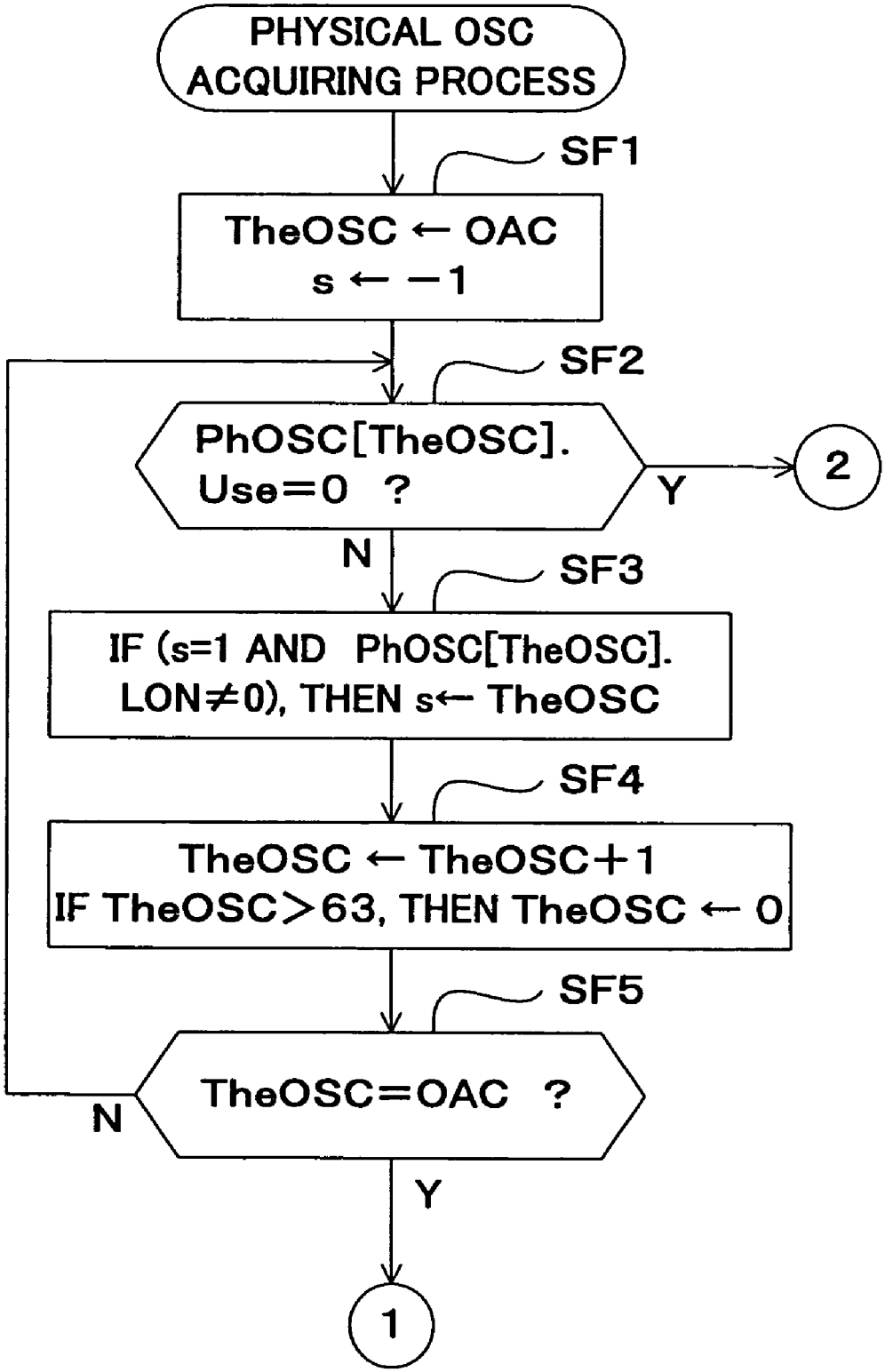
FIG. 15 is a flowchart showing physical OSC acquiring process operations.

Next, the physical OSC acquiring process operation will be explained with reference to FIG. 15 to FIG. 16. When the present process is performed via Step SD9 of the note-ON process described above (see FIG. 13) or Step SM15 of the envelope process described hereafter (see FIG. 24), the CPU 4 proceeds to Step SF1 shown in FIG. 15. At Step SF1, the CPU 4 stores an initial value "−1" in a register s and sets the value of the register OAC in a register TheOSC.

The register OAC is defined as a counter in which a next channel number is set, every time the sound production assignment is performed on the physical oscillators of the 64 channels. The value circulates within a range of "0" to "63". Therefore, at Step SF1, the CPU 4 sets the value of the register OAC in the register TheOSC as the initial value of the physical oscillator performing the sound production assignment. Hereinafter, the content of the register TheOSC is referred to as a physical oscillator number TheOSC.

Next, at Step SF2, the CPU 4 judges whether the flag Use (PhOSC[TheOSC].Use), within the register PhOSC [TheOSC] specified by the logical oscillator number TheOSC, is set to "0". The register PhOSC[TheOSC] is provided within the physical/logical oscillator correspondence parameter registers shown in FIG. 6A. In other words, the CPU 4 judges whether the physical oscillator specified by the physical oscillator number TheOSC is not in use. When the physical oscillator is in use, the judgment result is "NO", and the CPU 4 proceeds to Step SF3.

At Step SF3, when the value in the register s is an initial value "−1" and the value in the register LON, within the register PhOSC[TheOSC] specified by the physical oscillator number TheOSC, is not "0", namely when the logical oscillator associated with the physical oscillator specified by the physical oscillator number TheOSC is the slave oscillator, the CPU4 stores the current physical oscillator number TheOSC in the register s. In other words, when at least one physical oscillator is used as the slave oscillator, the physical oscillator number thereof is stored in the register s.

Next, at Step SF4, the CPU 4 incrementally increases the physical oscillator number TheOSC. When the incremented physical oscillator number TheOSC exceeds "63", the CPU 4 returns the physical oscillator number TheOSC to "0". Then, at Step SF5, the CPU 4 judges whether the incremented physical oscillator number TheOSC matches the value in the register OAC. In other words, the CPU 4 judges whether one round has been made. When one round has been made, the judgment result is "NO", and the CPU 4 returns to Step SF2.

In this way, at Steps SF2 to SF5, the CPU 4 finds the physical oscillator that is not in use (PhOSC[TheOSC].Use=0) from within the register PhOSC[TheOSC], while incrementally increasing the physical oscillator number TheOSC until one round is made and the physical oscillator number TheOSC returns to the value of the register OAC. When the physical oscillator that is not in use (PhOSC [TheOSC].Use=0) is found during this process, the judgment result at Step SF2 is "YES", and the CPU 4 proceeds to Step SF10 shown in FIG. 16.

At Step SF10, the CPU 4 stores the physical oscillator number TheOSC that is incrementally increased by steps in the register OAC and completes the process. The physical oscillator number TheOSC is stored as the physical oscillator number that is the next sound production assignment subject. In other words, when the physical oscillator that is not in use is found, the process is completed in a state in which the physical oscillator number of the found physical oscillator is set in the TheOSC, regardless of the value of the physical oscillator acquiring flag AsnFlg, described hereafter. When the incremented physical oscillator number TheOSC exceeds "63", the register OAC is returned to "0".

Figure 16:
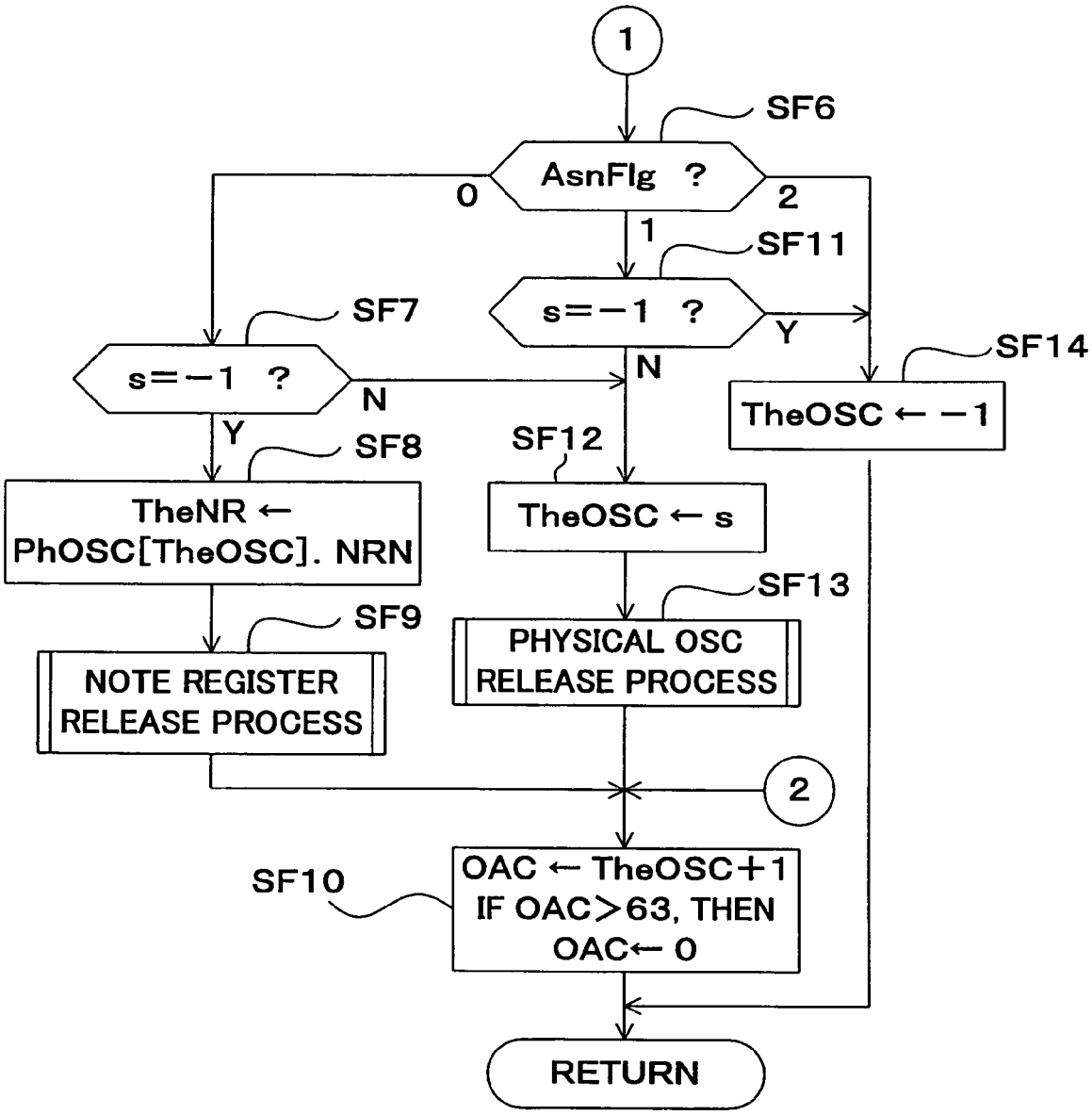
FIG. 16 is a flowchart showing physical OSC acquiring operations.

At the same time, when the physical oscillator that is not in use (PhOSC[TheOSC].Use=0) cannot be found even when the physical oscillator number TheOSC is incrementally increased by steps until the value makes one round and returns to the value of the register OAC, namely when all physical oscillators are in use, the judgment result at Step SF5 is "YES", and the CPU 4 proceeds to Step SF6 shown in FIG. 16.

After Step SF6, the CPU 4 acquires the physical oscillator number of the physical oscillator to be the sound production assignment subject, according to the value of the physical oscillator acquiring flag AsnFlg. The physical oscillator acquiring flag AsnFlg is set to "0" by the note-ON process and is further set to "1" or "2" in the envelope process described hereafter (see FIG. 24). Hereafter, operations are separated into when the physical oscillator acquiring flag AsnFlg is set to "0", "1", and "2" and explained.

<Operation when Physical Oscillator Acquiring Flag Asnflg is "0">

When the physical oscillator acquiring flag AsnFlg is set to "0", the CPU 4 proceeds from Step SF6 to Step SF7 and judges whether the value of the register s is the initial value "−1". In other words, the CPU 4 judges whether all physical oscillators are being used as the master oscillator. When all physical oscillators are being used as the master oscillators, the judgment result is "YES", and the CPU 4 proceeds to Step SF8. At Step SF8, the CPU 4 sets the note parameter register number. NRN (PhOSC[TheOSC].NRN) in the note parameter register number TheNR. The note parameter register number NRN (PhOSC[TheOSC].NRN) is provided within the register PhOSC[TheOSC], specified by the physical oscillator number TheOSC.

Then, the CPU 4 proceeds to Step SF9 and performs the note register release process. As described above, in the note register release process, the CPU 4 stops the sound production of all physical oscillators associated with the logical oscillators (the master oscillators and slave oscillators) assigned to the note parameter register NR[TheNR]. The note parameter register NR[TheNR] is specified by the note parameter register number TheNR set at Step SF8. Then, the CPU 4 sets the flag Use (NR[TheNR].LOSC[0].Use) of the master oscillator assigned to the note parameter register NR[TheNR] to not be in use. The note parameter register NR[TheNR] is specified by the note parameter register number TheNR.

When the note register release process is completed, the CPU 4 proceeds to Step SF10. The CPU 4 stores the physical oscillator number TheOSC that has been incrementally increased by steps in the register OAC as the physical oscillator number of the next sound production assignment subject and completes the present process. When the incremented physical oscillator TheOSC exceeds "63", the CPU 4 returns the register OAC to "0".

On the other hand, when at least one physical oscillator is used as the slave oscillator, the judgment result at Step SF7 is "NO", and the CPU 4 proceeds to Step SF12. At Step SF12, the CPU 4 sets the physical oscillator number of the register s as the physical oscillator number TheOSC.

Next, at Step SF13, the CPU 4 performs the physical OSC release process. As described hereafter, in the physical OSC release process, the CPU 4 stops the sound production of the physical oscillator of the physical oscillator number TheOSC set at Step SF12. At the same time, in accompaniment with the sound production being stopped, the CPU 4 updates the content (the flag Use and the register AON) of the logical oscillator parameters in the note parameter register NR. In correspondence with the update, the CPU 4 changes the contents of the physical/logical oscillator correspondence parameter registers PhOSC (PhOSC[TheOSC].Use) and the contents of the oscillator parameter registers PROSC (PROSC[TheOSC]. RUN).

Subsequently, the CPU 4 proceeds to Step SF10. The CPU 4 stores the physical oscillator number TheOSC that has been incrementally increased by steps in the register OAC as the physical oscillator number of the next sound production assignment subject and completes the process. When the incremented physical oscillator TheOSC exceeds "63", the CPU 4 returns the register OAC to "0". In other words, when the physical oscillator acquiring flag AsnFlg is set to "0", if a physical oscillator is being used as the slave oscillator, the physical oscillator number of the physical oscillator is set in TheOSC. At the same time, when no physical oscillator is being used as the slave oscillator, the physical oscillator number of the physical oscillator being used as the master oscillator is set in TheOSC. In other words, the physical oscillator to become the sound production assignment subject is always acquired.

<Operation when Physical Oscillator Acquiring Flag Asnflg is "1">

When the physical oscillator acquiring flag AsnFlg is set to "1", the CPU 4 proceeds from Step SF6 to Step SF11 and judges whether the value on the register s is the initial value "−1". In other words, the CPU 4 judges whether all physical oscillators are being used as the master oscillator. When all physical oscillators are being used as the master oscillator, the judgment result is "YES", and the CPU 4 proceeds to Step SF14. The CPU 4 sets the physical oscillator number TheOSC to "−1" and completes the present process. In other words, when all physical oscillators are being used as the master oscillator, the CPU 4 completes the present process without acquiring the physical oscillator number to be the sound production assignment subject.

At the same time, when the judgment result at Step SF11 is "NO", namely at least one physical oscillator is used as the slave oscillator, the CPU 4 proceeds to Step SF12. The CPU 4 sets the physical oscillator number of the register s as the physical oscillator number TheOSC. Next, at Step SF13, the CPU 4 instructs the sound source 8 to stop the sound production of the physical oscillator of the physical oscillator number TheOSC set at Step SF12. At the same time, in accompaniment with the sound production being stopped, the CPU 4 updates the content (the flag Use and the register AON) of the logical oscillator parameters in the note parameter register NR. In correspondence with the update, the CPU 4 performs the physical OSC release process that changes the contents of the physical and logical oscillator correspondence parameter registers PhOSC (PhOSC[TheOSC].Use) and the contents of the oscillator parameter registers PROSC (PROSC [TheOSC]. RUN).

Subsequently, the CPU 4 proceeds to Step SF10. The CPU 4 stores the physical oscillator number TheOSC that has been incrementally increased by steps in the register OAC as the physical oscillator number of the next sound production assignment subject and completes the present process. When the incremented physical oscillator TheOSC exceeds "63", the CPU 4 returns the register OAC to "0". In other words, when the physical oscillator acquiring flag AsnFlg is set to "1", if a physical oscillator is being used as the slave oscillator, the physical oscillator number of the physical oscillator is set in TheOSC. At the same time, when no physical oscillator is being used as the slave oscillator, TheOSC is set to "−1". In other words, the physical oscillator to become the sound production assignment subject is only acquired when a physical oscillator is being used as the slave oscillator.

<Operation when Physical Oscillator Acquiring Flag Asnflg is "2">

When the physical oscillator acquiring flag AsnFlg is set to "2", the CPU 4 proceeds from Step SF6 to Step SF14. The CPU 4 sets the physical oscillator number TheOSC to "−1" and completes the present process. In other words, when all physical oscillators are in use, the CPU 4 completes the present process without acquiring the physical oscillator number to become the sound production assignment subject.

B-7. Physical OSC Release Process Operation

Figure 17:
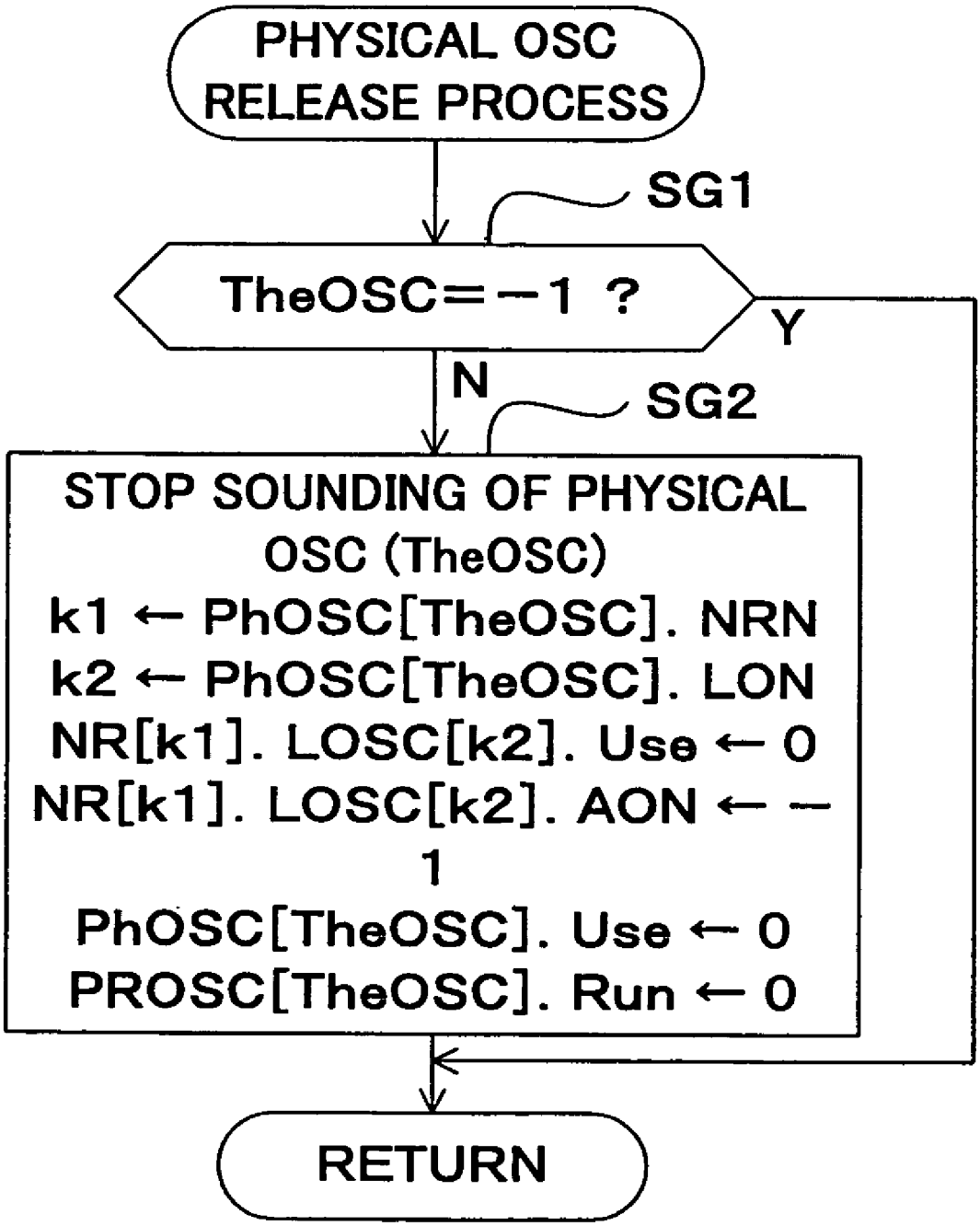
FIG. 17 is a flowchart showing physical OSC release operations.

Next, the physical OSC release process will be explained with reference to FIG. 17. When the present process is performed via Step SF13 of the physical OSC acquiring process described above (see FIG. 16) or Step SM12 of the envelope process described hereafter (see FIG. 24), the CPU 4 proceeds to Step SG1 shown in FIG. 17. At Step SG1, the CPU 4 judges whether the physical oscillator number TheOSC is "−1". In other words, the CPU 4 judges whether the state is that in which the physical oscillator number TheOSC is not acquired in the physical OSC acquiring process (see FIG. 15 to FIG. 16). When the state is that in which the physical oscillator number TheOSC is not acquired, the judgment result is "YES", and the CPU 4 completes the process without performing any operations.

At the same time, when the physical oscillator number TheOSC is acquired, the judgment result at Step SG1 is "NO", and the CPU 4 proceeds to Step SG2. At Step SG2, the CPU 4 stops the sound production of the physical oscillator specified by the physical oscillator number TheOSC. In addition, at Step SG2, the CPU 4 stores the note parameter register number NRN (PhOSC[TheOSC].NRN) in a register k1. The note parameter register number NRN (PhOSC[TheOSC]

.NRN) is provided within the register PhOSC specified by the physical oscillator number TheOSC. The CPU 4 also stores the logical oscillator number LON (PhOSC[TheOSC].LON) in a register k2. The logical oscillator number LON (PhOSC [TheOSC].LON) is provided within the register PhOSC [TheOSC] specified by the physical oscillator number TheOSC.

Furthermore, at Step SG2, the CPU 4 sets the flag Use (NR[k1].LOSC[k2].Use) within the register LOSC[k2] specified by the logical oscillator number LON of the register k2 to "0". "0" indicates that the logical oscillator is not in use. The register LOSC[k2] is provided within the note parameter register NR[k1], specified by the note parameter register number NRN in the register k1. The CPU 4 also stores "−1" in the register AON (NR[k1].LOSC[k2].AON).

Still further, at Step SG2, the CPU 4 sets the flag Use (PhOSC[TheOSC].Use) within the register PhOSC [TheOSC] specified by the physical oscillator number TheOSC to "0". "0" indicates that the physical oscillator is not in use. At the same time, the CPU 4 sets the flag RUN (PhOSC[TheOSC].RUN) within the oscillator parameter register PhOSC[TheOSC] specified by the physical oscillator number TheOSC to "0" and sets the physical oscillator of the physical oscillator number TheOSC to not be in operation.

In this way, in the physical OSC release process, the CPU 4 stops the sound production of the physical oscillator of the physical oscillator number TheOSC acquired by the physical OSC acquiring process. In accompaniment with the sound production being stopped, the CPU 4 updates the contents (the flag Use and the register AON) of the logical oscillator parameter of the note parameter register NR. In correspondence with the update, the CPU 4 changes the contents of the physical and logical oscillator correspondence parameter registers PhOSC (PhOSC[TheOSC].Use) and the contents of the oscillator parameter registers PROSC (PROSC[TheOSC]. RUN).

B-8. OSC Parameter Setting Process Operation

Figure 18:
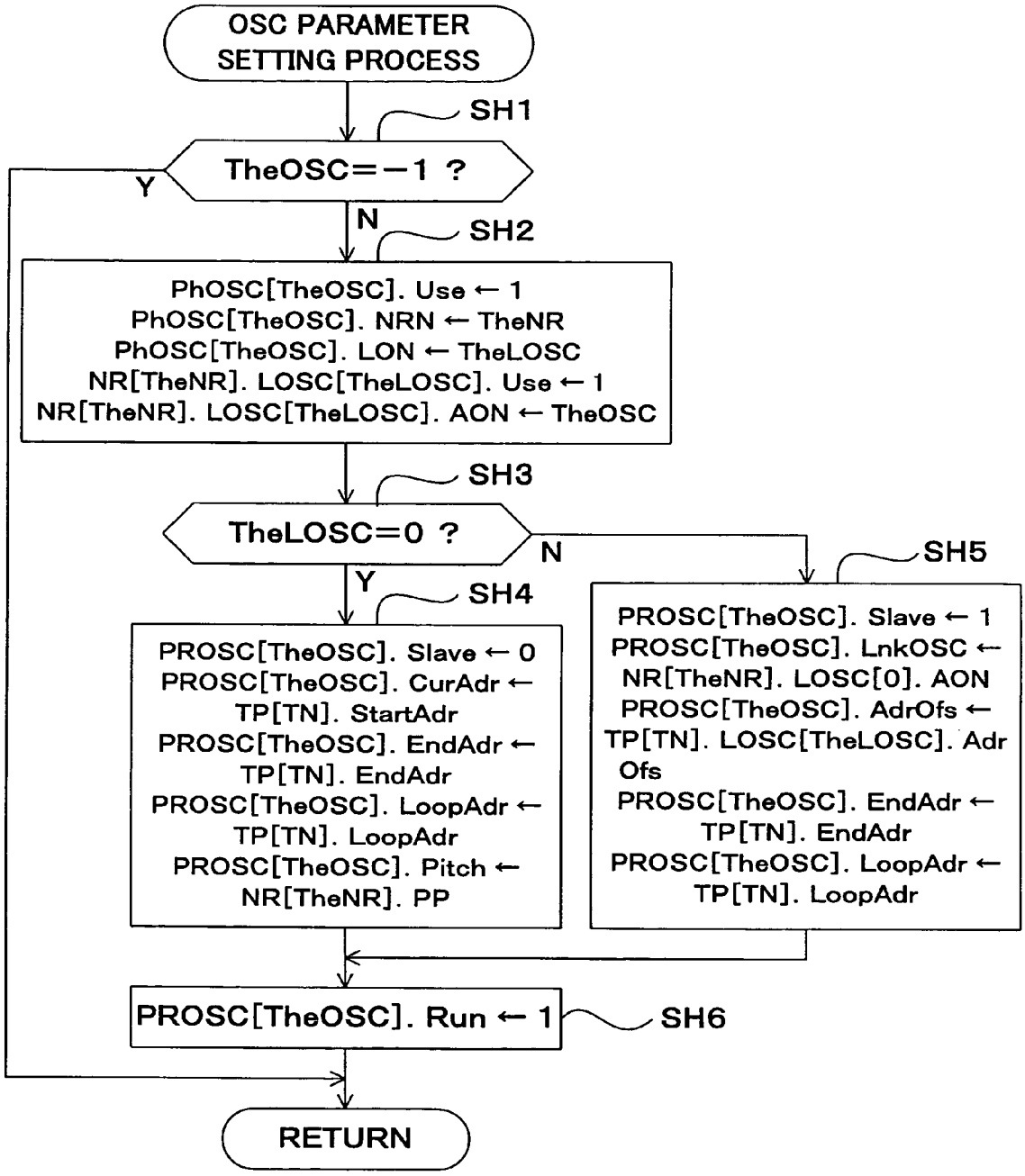
FIG. 18 is a flowchart showing OSC parameter setting process operations.

Next, the parameter setting process operation will be described with reference to FIG. 18. When the present process is performed via Step SD11 of the note-ON process described above (see FIG. 13) or Step SM17 of the envelope process described hereafter (see FIG. 24), the CPU 4 proceeds to Step SH1 shown in FIG. 18. At Step SH1, the CPU 4 judges whether the physical oscillator number TheOSC is "−1". In other words, the CPU 4 judges whether the state is that in which the physical oscillator number TheOSC is not acquired in the physical OSC acquiring process (see FIG. 15 to FIG. 16). When the state is that in which the physical oscillator number TheOSC is not acquired, the judgment result is "YES", and the CPU 4 completes the present process without performing any operations.

At the same time, when the physical oscillator number TheOSC is acquired, the judgment result at Step SH1 is "NO", and the CPU 4 proceeds to Step SH2. At Step SH2, the CPU 4 sets the flag Use (PhOSC[TheOSC].Use) within the register PhOSC[TheOSC] specified by the physical oscillator number TheOSC to "1". "1" indicates that the flag Use is in use. The register PhOSC[TheOSC] is provided within the physical/logical oscillator correspondence parameter registers shown in FIG. 6A. The CPU 4 also stores the note parameter register number TheNR in the register NRN (PhOSC [TheOSC].NRN), provided within the register PhOSC [TheOSC] specified by the physical oscillator number TheOSC.

In addition, at Step SH2, the CPU 4 stores the logical oscillator number TheLOSC in the register LON (PhOSC [TheOSC].LON), provided within the register PhOSC [TheOSC] specified by the physical oscillator number TheOSC. Furthermore, at Step SH2, the CPU 4 sets the flag Use (NR[TheNR].LOSC[TheLOSC].Use) within the register LOSC[TheLOSC] specified by the logical oscillator number TheLOSC to "1". "1" indicates that the flag Use is in use. The register LOSC[TheLOSC] is provided within the note parameter register NR[TheNR] specified by the note parameter register number TheNR.

Still further, at Step SH2, the CPU 4 stores the physical oscillator number TheOSC in the register AON (NR[TheNR]. LOSC[TheLOSC].AON), provided within the register LOSC [TheLOSC] specified by the logical oscillator number TheLOSC. The register LOSC[TheLOSC] is provided within the note parameter register NR[TheNR] specified by the note parameter register number TheNR.

In this way, after completing the parameter settings for sounding the physical oscillator of the physical oscillator number TheOSC acquired by the physical OSC acquiring process, the CPU 4 proceeds to Step SH3. The CPU 4 judges whether the logical oscillator number TheLOSC corresponding to the physical oscillator of the physical oscillator number TheOSC is "0". In other words, the CPU 4 judges whether the physical oscillator is the master oscillator. When the physical oscillator is the master oscillator, the judgment result is "YES", and the CPU 4 proceeds to Step SH4.

At Step SH4, the CPU 4 sets the flag Slave (PROSC [TheOSC].Slave) within the register PROSC[TheOSC] specified by the physical oscillator number TheOSC, to "0". "0" indicates that the physical oscillator of the physical oscillator number TheOSC is not used as the slave oscillator. The register PROSC[TheOSC] is provided within the oscillator parameter register PROSC shown in FIG. 2A In addition, at Step SH4, the CPU stores the start address StartAdr in the register CurAdr of the register PROSC specified by the physical oscillator number TheOSC. The start address StartAdr is provided within the tone parameters TP[TN] specified by the tone number TN, selected according to the tone selection switch operations.

Furthermore, at Step SH4, the CPU 4 stores the end address EndAdr in the register EndAdr, provided within the register PROSC[TheOSC] specified by the physical oscillator number TheOSC. The end address EndAdr is provided within the tone parameters TP[TN] specified by the tone number TN.

Still further, at Step SH4, the CPU 4 stores the loop address LoopAdr in the register LoopAdr of the register PROSC [TheOSC] specified by the physical oscillator number TheOSC. The loop address LoopAdr is provided within the tone parameter TP[TN] specified by the tone number TN.

Still further, at Step SH4, the CPU 4 stores the pitch displacement (the read-out speed during sound production), stored in the register PP, in the register Pitch within the register PROSC[TheOSC] specified by the physical oscillator number TheOSC. The register PP is provided within the note parameter register NR[TheNR] specified by the note parameter register number TheNR.

When the waveform generation mode (the start address StartAdr, the end address EndAdr, the loop address LoopAdr, and the read-out speed of the waveform data of the selected tone) of the physical oscillator operating as the master oscillator is set in this way, the CPU 4 proceeds to Step SH6. The CPU 4 sets the flag RUN of the register PROSC[TheOSC] specified by the physical oscillator umber TheOSC to "1" and completes the process. As a result, the waveform is output according to the set waveform generation mode with the physical oscillator of the physical oscillator number TheOSC as the master oscillator.

At the same time, when the physical oscillator of the physical oscillator number TheOSC operates as the slave oscillator, the judgment result at Step SH3 is "NO", and the CPU 4 proceeds to Step SH5. At Step SH5, the CPU 4 sets the flag Slave (PROSC[TheOSC].Slave) within the register PROSC [TheOSC] specified by the physical oscillator number TheOSC to "1". "1" indicates that the physical oscillator of the physical oscillator number TheOSC operates as the slave oscillator.

In addition, at Step SH5, the CPU 4 stores the physical oscillator number, stored in the register AON (NR[TheNR] .LOSC[0].AON), in the register LnkOSC (PROSC[TheOSC] .LnkOSC) provided within the register PROSC[TheOSC] specified by the physical oscillator number TheOSC. The physical oscillator number is stored as the master oscillator number. The register AON (NR[TheNR].LOSC[0].AON) is provided within the register LOSC[0] of the master oscillator, within the note parameter register NR[TheNR] specified by the note parameter register number TheNR.

Furthermore, at Step SH5, the CPU 4 stores the off-set address AdrOfs (the difference between the waveform read-out address of the slave oscillator and the waveform read-out address of the master oscillator) in the register AdrOfs within the register PROSC[TheOSC] specified by the physical oscillator number TheOSC. The off-set address AdrOfs is provided within the logical oscillator parameter LOSC[TheLOSC] specified by the logical oscillator number TheLOSC. The logical oscillator parameter LOSC[TheLOSC] is provided within the tone parameter TP[TN] specified by the tone number TN.

Still further, at Step SH5, the CPU 4 stores the end address EndAdr in the register EndAdr within the register PROSC [TheOSC] specified by the physical oscillator number TheOSC. The end address EndAdr is provided within the tone parameter TP[TN], specified by the tone number TN. The CPU 4 also stores the loop address LoopAdr in the register LoopAdr within the register PROSC[TheOSC] specified by the physical oscillator number TheOSC. The loop address LoopAdr is provided within the tone parameter TP[TN] specified by the tone number TN.

When the waveform generation mode of the physical oscillator operating as the slave oscillator (the off-set address AdrOfs indicating the difference between the waveform read-out address of the slave oscillator and the waveform read-out address of the master oscillator, the end address EndAdr, and the loop address LoopAdr) is set in this way, the CPU 4 proceeds to Step SH6. The CPU 4 sets the flag RUN of the register PROSC[TheOSC] specified by the physical oscillator number TheOSC to "1" and completes the present process. As a result, the waveform is output according to the set waveform generation mode, with the physical oscillator of the physical oscillator number TheOSC as the slave oscillator.

B-9. Note-OFF Process Operation

Figure 19:
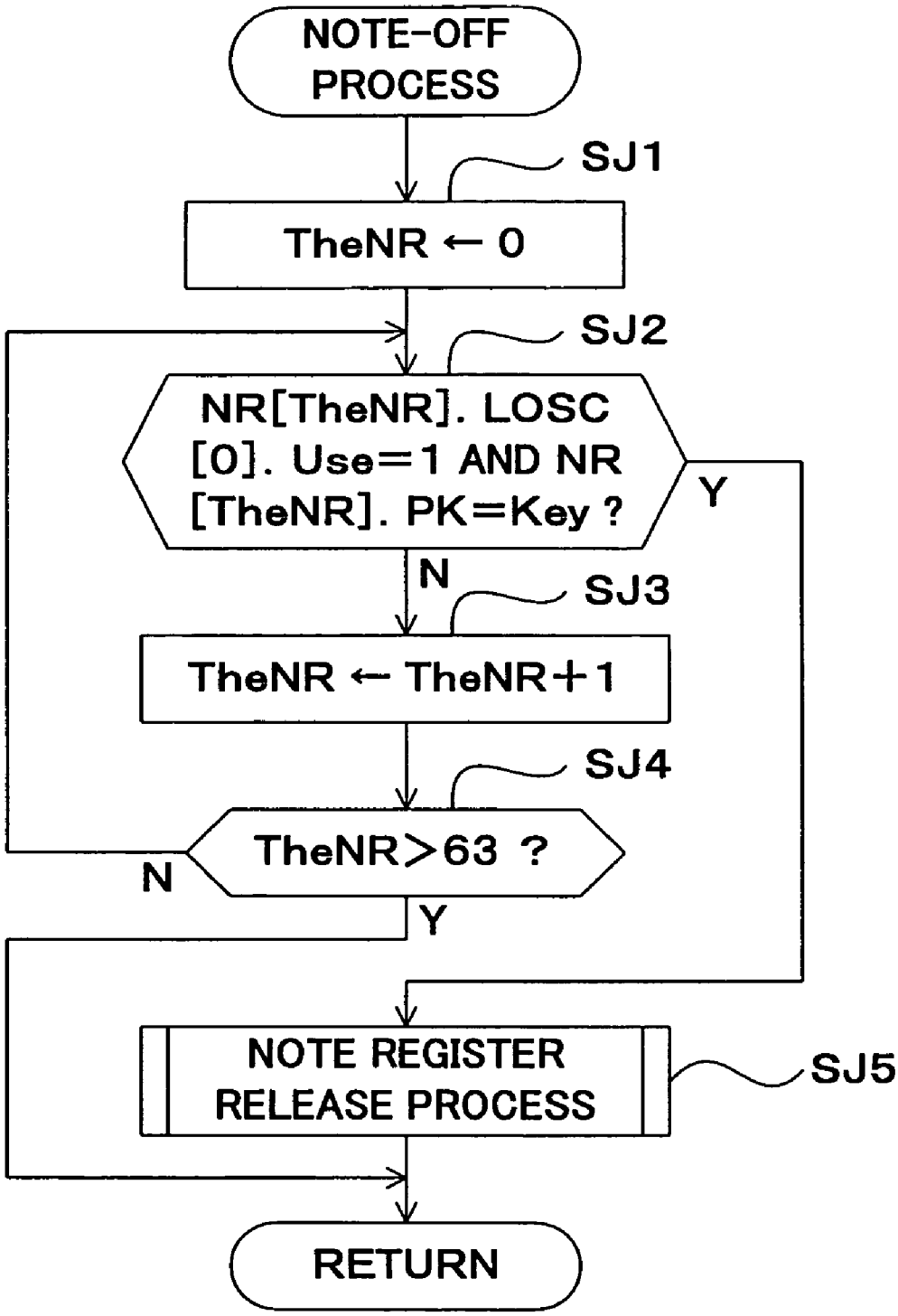
FIG. 19 is a flowchart showing note-OFF process operations.
Figure 20:
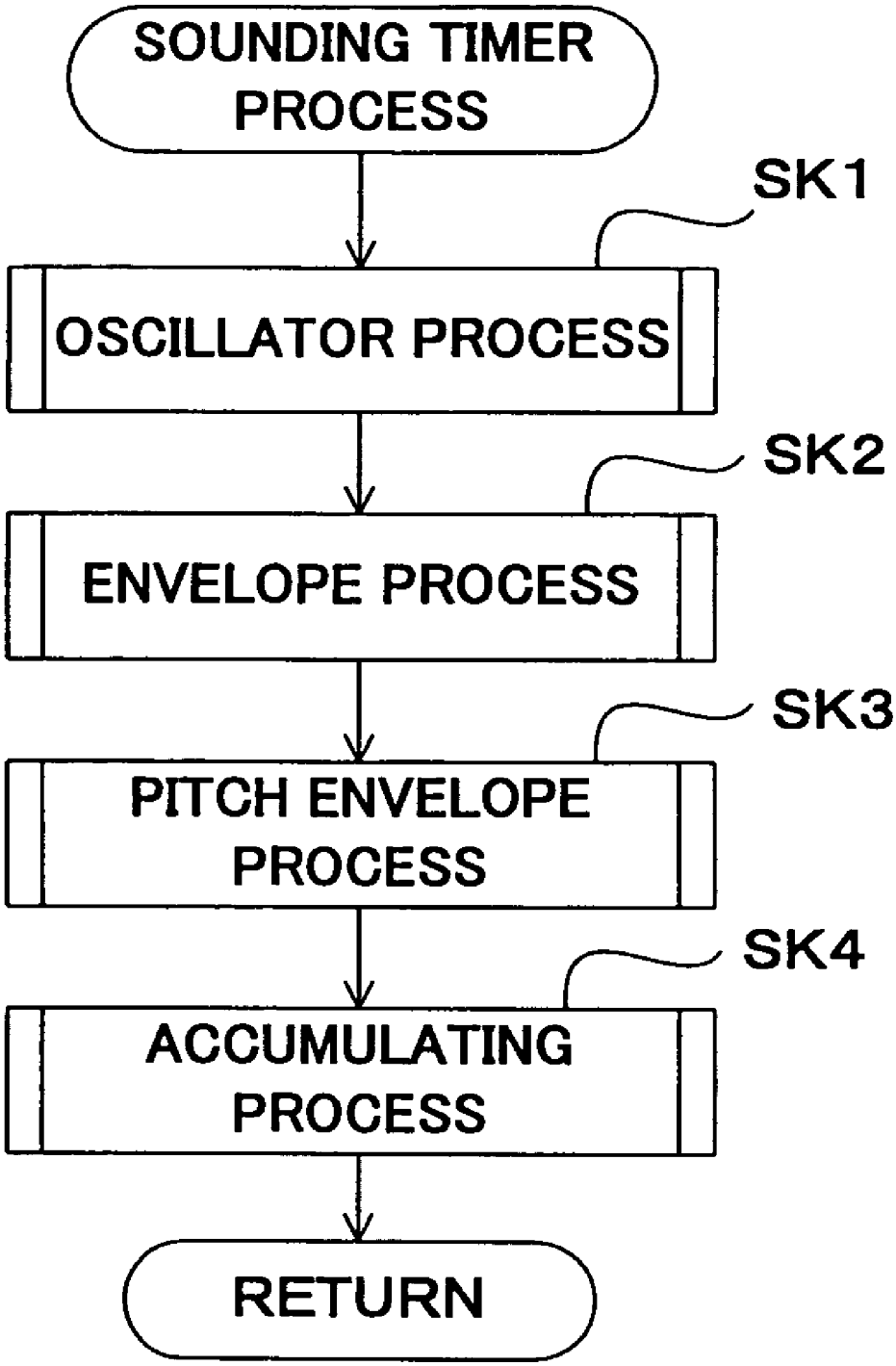
FIG. 20 is a flowchart showing sound production timer process operations.

Next, the note-OFF process operation will be explained with reference to FIG. 19. When the present process is performed via Step SC5 of the keyboard process described above (see FIG. 11), the CPU 4 proceeds to Step SJ1 shown in FIG. 19 and resets the note parameter register number TheNR to zero. Next, at Step SJ2, the CPU 4 judges whether the master oscillator assigned to the note parameter register NR[TheNR] is in use (NR[TheNR].LOSC[0].Use=1). The note parameter register NR[TheNR is specified by the note parameter register number TheNR. Furthermore, the CPU 4 judges whether the performance key PK within the note parameter register NR[TheNR] matches the key number Key of the released key. The note parameter register NR[TheNR is specified by the note parameter register number TheNR. In other words, the CPU 4 judges whether the sound is to be attenuated.

If the sound is not to be attenuated, the judgment result is "NO", and the CPU 4 proceeds to Step SJ3. The CPU 4 incrementally increases the note parameter register number TheNR by steps. Then, at Step SJ4, the CPU 4 judges whether the incremented note parameter register number TheNR exceeds "63". In other words, the CPU 4 judges whether search is completed. If the search is not completed, the judgment result is "NO", and the CPU 4 returns to Step SJ2.

Subsequently, the CPU 4 repeats Steps SJ2 to SJ4 while incrementally increasing the note parameter register number TheNR by steps until the search for the sound to be attenuated is completed. When the search is completed without the sound to be attenuated being found, the judgment result at Step SJ4 is "YES", and the process is completed. On the other hand, if the sound to be attenuated is found, the judgment result at Step SJ2 is "YES", and the CPU 4 proceeds to Step SJ5.

At Step SJ5, as described above, the CPU 4 stops the sound production of all physical oscillators associated with the logical oscillators (the master oscillators and the slave oscillators) assigned to the note parameter register NR[TheNR] specified by the note parameter register number TheNR. Then, the CPU 4 performs the note register release process (see FIG. 14) for setting the flag Use (NR[TheNR].LOSC[0].Use) of the master oscillator assigned to the note parameter register NR[TheNR] to not be in use and completes the present process. The note parameter register NR[TheNR] is specified by the note parameter register number TheNR.

B-10. Sound Production Timer Process Operation

The sound production timer process (see FIG. 20) is a process that is performed by an interrupt at each sampling cycle. The sound production timer process includes the oscillator process at Step SK1, the envelope process at Step SK2, the pitch envelope process at Step SK3, and the accumulating process at Step SK4.

B-11. Oscillator Process Operation

Figure 21:
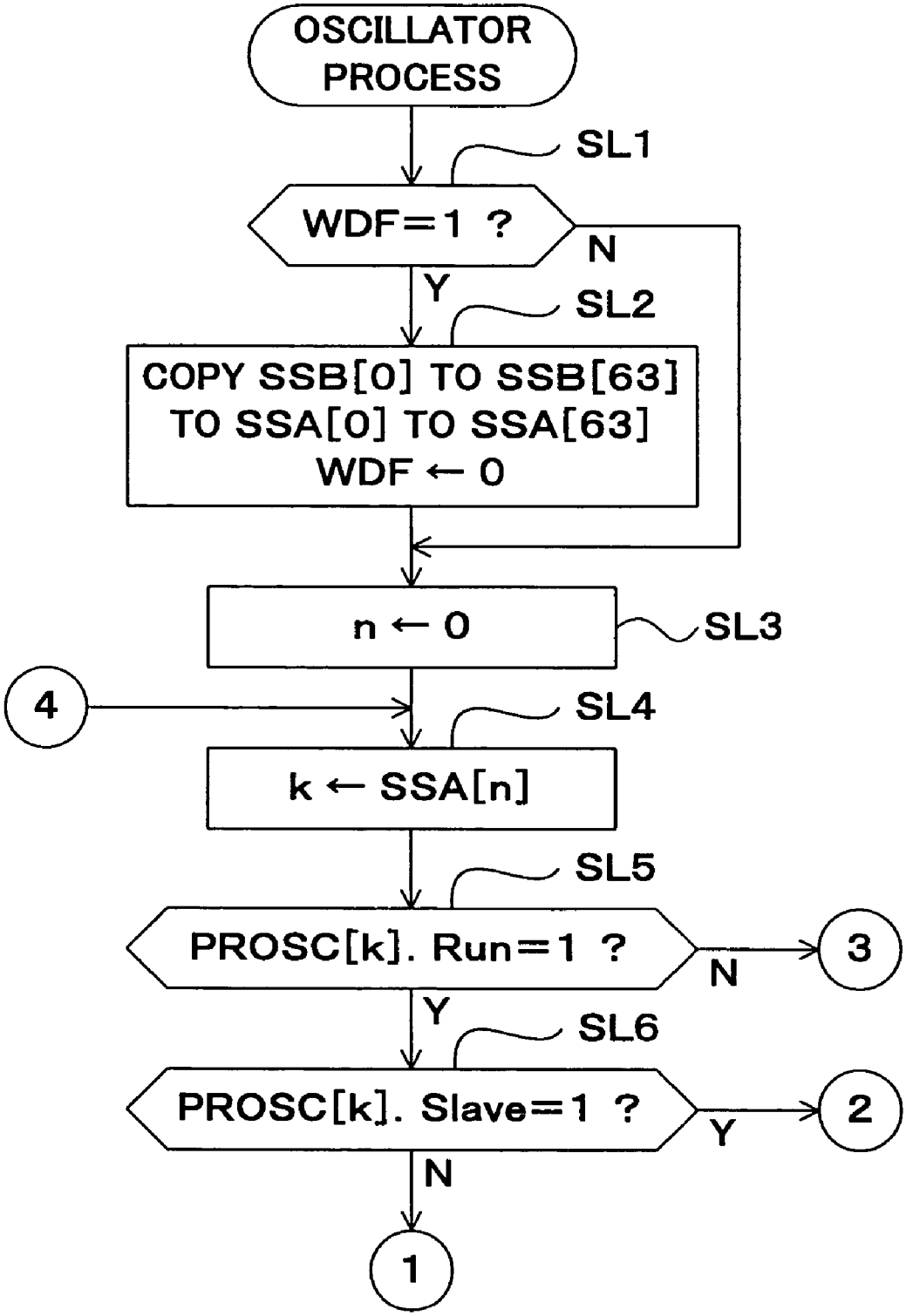
FIG. 21 is a flowchart showing oscillator process operations.
Figure 22:
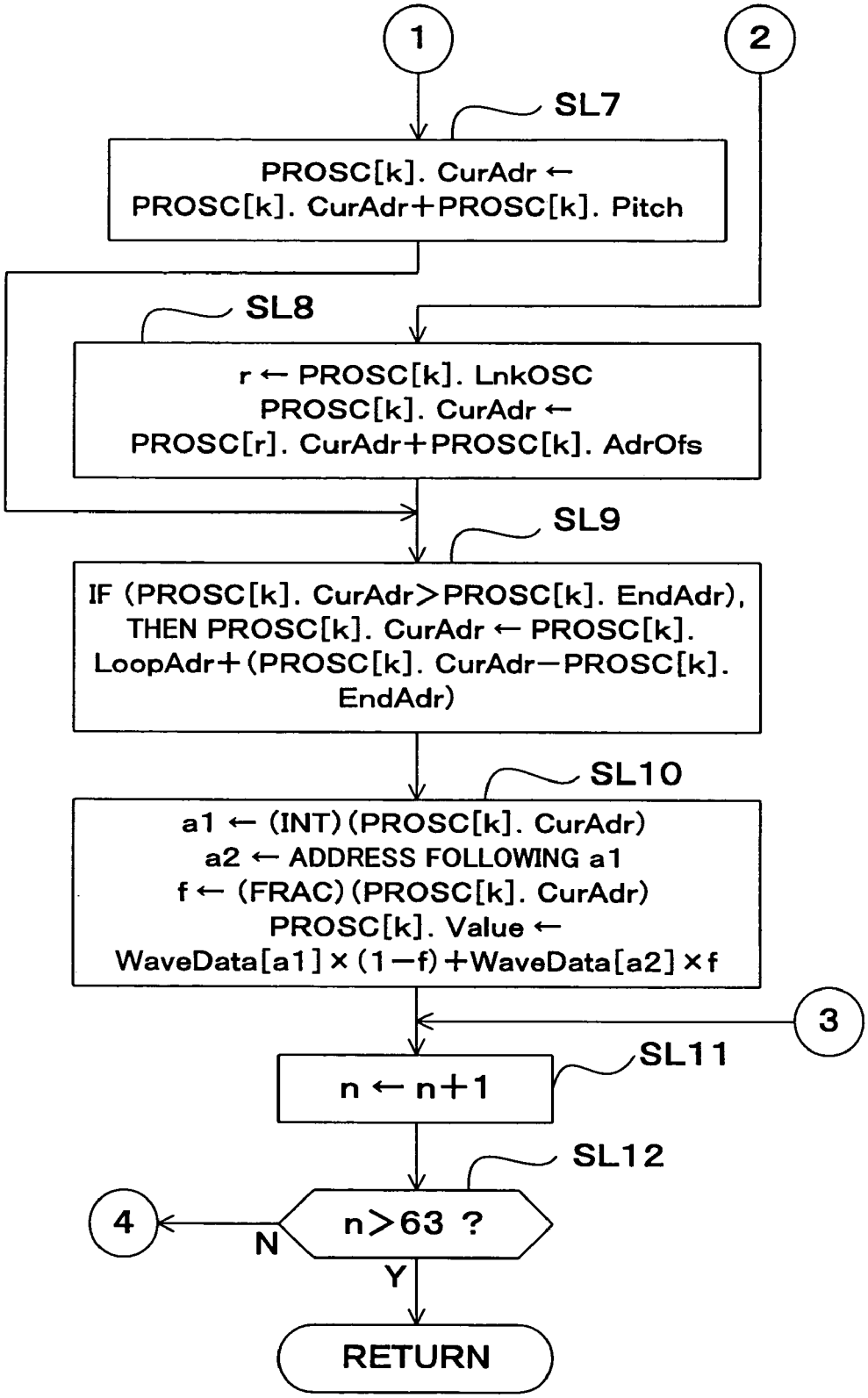
FIG. 22 is a flowchart showing oscillator process operations.

Next, the oscillator process will be explained with reference to FIG. 21 to FIG. 22. When the present process is performed via Step SK1 of the sound production timer process (see FIG. 20), the CPU 4 proceeds to Step SL1 shown in FIG. 21. At Step SL1, the CPU 4 judges whether the flag WDF within the schedule parameter register shown in FIG. 2B is "1". In other words, the CPU 4 judges whether the processing sequence of the oscillators stored in the registers SSB[0] to SSB[63] is updated. When the processing sequence of the oscillators stored in the registers SSB[0] to SSB[63] is not updated, the judgment result is "NO", and the CPU 4 proceeds to Step SL3, described hereafter.

At the same time, when the processing sequence of the oscillators stored in the registers SSB[0] to SSB[63] is updated, the judgment result at Step SL1 is "YES", and the CPU 4 proceeds to StepSL2. At Step SL2, the CPU 4 copies the processing sequence of the oscillators stored in the registers SSB[0] to SSB[63] for generating waveforms by time-sharing within one sampling cycle to the registers SSA[0] to SSA[63]. In addition, the CPU 4 resets the flag WDF to zero and proceeds to the subsequent Step SL3.

At Step SL3, the CPU 4 resets the pointer n to zero. Next, at Step SL4, the CPU 4 stores the value of the register SSA[n], specified by the pointer n, in the register k. Then, at Step SL5, the CPU 4 judges whether the flag RUN (PROSC[k].RUN), within the oscillator parameter register PROSC[k] specified in the register k, is "1". In other words, the CPU 4 judges whether the physical oscillator specified by the value in the register SSA[n] is in operation. If the physical oscillator is not in operation, the judgment result is "NO", and the CPU 4 proceeds to Step SL11, shown in FIG. 22. The CPU 4 incrementally increases the pointer n by steps. Next, at Step SL12, the CPU 4 judges whether the value of the incremented pointer n exceeds "63". In other words, the CPU 4 judges whether the waveform generation of all 64 oscillators is completed.

When the waveform generation of all oscillators is not completed, the judgment result is "NO", and the CPU returns to Step SL4, described hereafter. The CPU 4 stores the value of the register SSA[n], specified by the incremented pointer n, in the register k. When the flag RUN (PROSC[k].RUN), within the oscillator parameter register PROSC[k] specified in the register k, is "1", namely the physical oscillator specified by the value of the register SSA[n] is in operation, the judgment result at Step SL5 is "YES", and the CPU 4 proceeds to Step SL6.

At Step SL6, the CPU 4 judges whether the flag Slave (PROSC[k].Slave), within the oscillator parameter register PROSC[k] specified in the register k, is "1". In other words, the CPU 4 judges whether the physical oscillator specified by the value in the register SSA[n] is used as the slave oscillator. When the value of PROSC[k].Slave is "0", namely when the physical oscillator is used as the master oscillator, the judgment result is "NO", and the CPU 4 proceeds to Step SL7 shown in FIG. 22.

At Step SL7, the CPU 4 adds a waveform read-out phase stored in the register Pitch (PROSC[k].Pitch) to the waveform read-out address stored in the register CurAdr (PROSC[k].CurAdr). The register Pitch (PROSC[k].Pitch) is provided within the oscillator parameter register PROSC[k] specified in the register k. The register CurAdr (PROSC[k].CurAdr) is provided within the oscillator parameter register PROSC[k] specified in the register k. Then, the CPU 4 updates the waveform read-out address of the PROSC[k].CurAdr and proceeds to Step SL9.

At the same time, when the value of PROSC[k]. Slave is "1", namely the physical oscillator is used as the slave oscillator, the judgment result at Step SL6 is "YES", and the CPU 4 proceeds to Step SL8 shown in FIG. 22. At Step SL8, the CPU 4 stores the master oscillator number, stored in the LnkOSC, in a register r. The LnkOSC is provided within the oscillator parameter register PROSC[k] specified in the register k.

In addition, at Step SL8, the CPU 4 adds the off-set address (the difference between the waveform read-out address of the slave oscillator and the waveform read-out address of the master oscillator), stored in the register AdrOfs (PROSC[k].AdrOfs) to the waveform read-out address stored in the register CurAdr (PROSC[k].CurAdr). The register AdrOfs (PROSC[k].AdrOfs) is provided within the oscillator parameter register PROSC[k] specified in the register k. The register CurAdr (PROSC[k].CurAdr) is provided within the oscillator parameter register PROSC[k] specified in the register k. Then, the CPU 4 updates the waveform read-out address of the PROSC[k].CurAdr and proceeds to Step SL9.

At Step SL9, when the waveform read-out address stored in the register CurAdr (PROSC[k].CurAdr) exceeds the end address stored in the register EndAdr (PROSC[k].EndAdr), the amount exceeded from the end address (PROSC[k].CurAdr-PROSC[k].EndAdr) is added to the loop address PROSC[k].LoopAdr. The register CurAdr (PROSC[k].CurAdr) is provided within the oscillator parameter register PROSC[k] specified in the register k. The register EndAdr (PROSC[k].EndAdr) is provided within the oscillator parameter register PROSC[k] specified in the register k. The addition result is set as the waveform read-out address of the PROSC[k].CurAdr.

Next, at Step SL10, the CPU 4 respectively stores the address integer section of the waveform read-out address PROSC[k].CurAdr in a register a1 and an address following the address integer section in a register a2. In addition, at Step SL10, the CPU 4 stores the address decimal section of the waveform read-out address PROSC[k].CurAdr in a register f.

In addition, at Step SL10, the CPU 4 performs interpolation (WaveData[a1]×(1−f)+WaveData[a2$xf$]) of a waveform value WaveData[a1] read out at the address in the register a1 and a waveform value WaveData[a2] read out at the address in the register a2, using the address decimal section in register f. Then, the CPU 4 stores the acquired waveform value in the register Value, within the oscillator parameter register PROSC[k] specified in the register k. When the waveform generation of all oscillators is completed in this way, the judgment result at Step SL12 is "YES", and the present process is completed.

B-12. Envelope Process Operation

Figure 23:
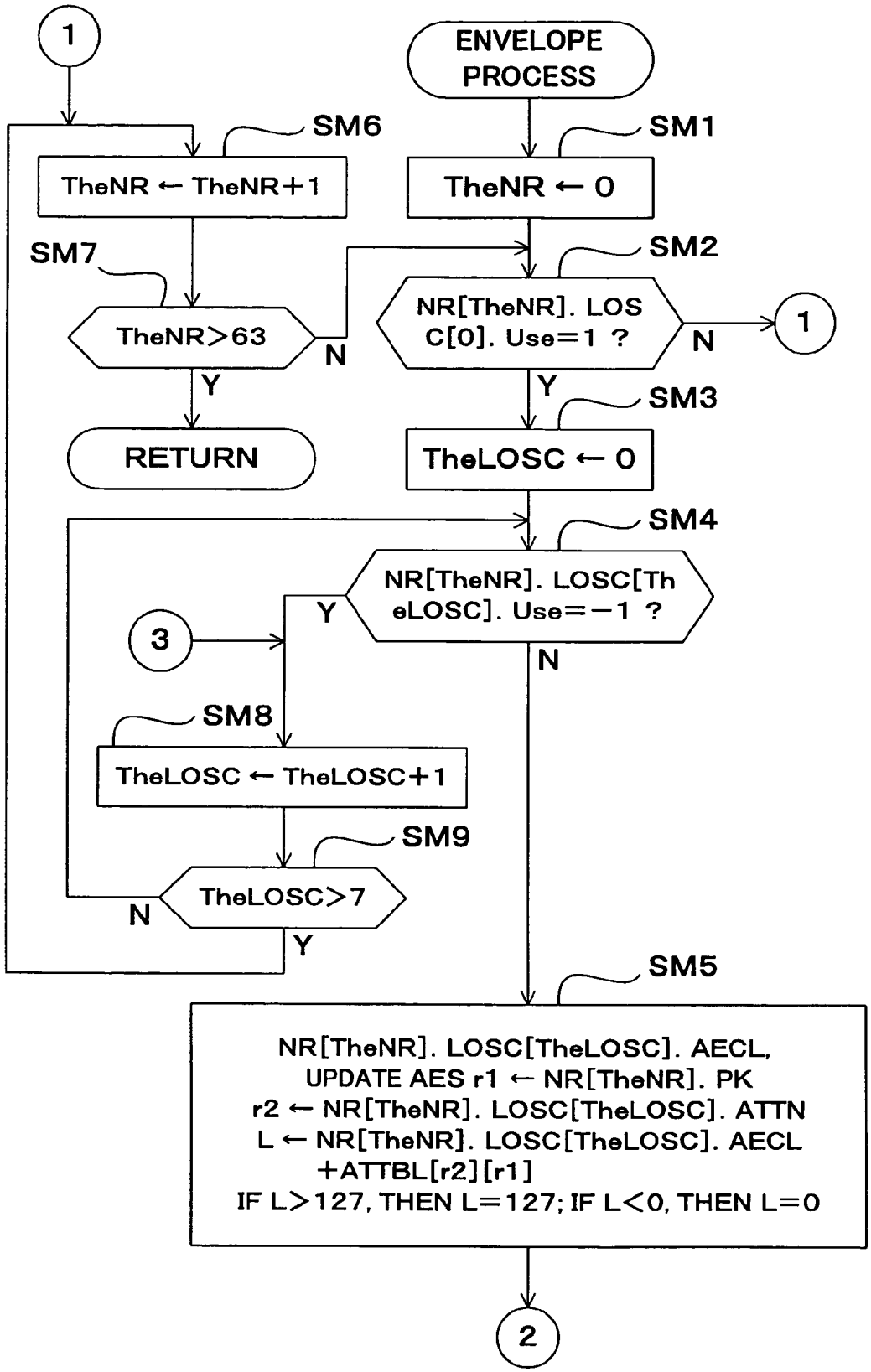
FIG. 23 is a flowchart showing envelope process operations.
Figure 24:
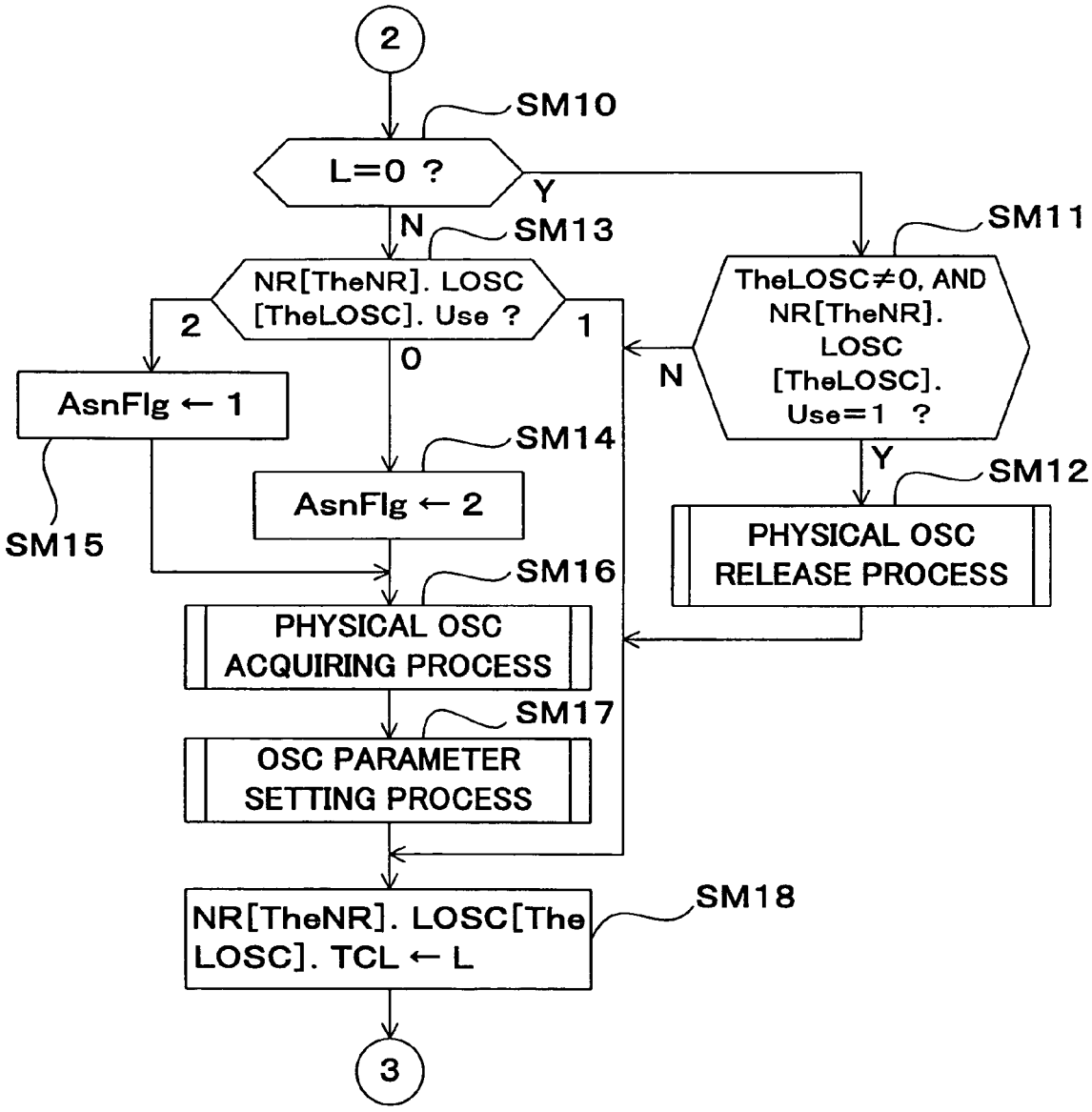
FIG. 24 is a flowchart showing envelope process operations.

Next, the envelope process operation will be explained with reference to FIG. 23 to FIG. 24. When the present process is performed via Step SK2 of the sound production timer process described above (see FIG. 20), the CPU 4 proceeds to Step SM1 shown in FIG. 23. The CPU 4 resets the note parameter register number TheNR to zero. Next, at Step SM2, the CPU4 judges whether the master oscillator assigned to the note parameter register NR[TheNR], specified by the note parameter register number TheNR, is in use (NR[TheNR].LOSC[0].Use=1).

When the master oscillator assigned to the note parameter register NR[TheNR], specified by the note parameter register number TheNR, is not in use (NR[TheNR].LOSC[0].Use=0), the judgment result is "NO", and the CPU 4 proceeds to Step SM6. The CPU 4 incrementally increases the note parameter register number TheNR by steps. Then, at Step SM7, the CPU4 judges whether the incremented note parameter register number TheNR exceeds "63". In other words, the CPU 4 judges whether the search for the master oscillator that is in use from within the note parameter registers NR[0] to NR[63] is completed.

When the search is not completed, the judgment result at Step SM7 is "NO", and the CPU 4 returns to Step SM 2 and continues the search. When the master oscillator that is in use is found by the search, the judgment result at Step SM2 is "YES", and the CPU 4 proceeds to Step SM3. The CPU 4 resets the logical oscillator number TheLOSC to zero.

Next, at Step SM4, Step SM8, and Step SM9, the CPU 4 searches for the slave oscillator that is not set to always not be in use, within the note parameter register NR[TheNR] to which the master oscillator that is in use is assigned. In the slave oscillator that is not set to always not be in use, the flag Use (NR[TheNR].LOSC[TheLOSC].Use) within the register LOSC[TheLOSC] specified by the logical oscillator number TheLOSC is set to any one of "0", "1", or "2". The register LOSC[TheLOSC] is provided within the note parameter register NR[TheNR] specified by the note parameter register number TheNR. Therefore, the judgment result at Step SM4 is "NO", and the CPU 4 proceeds to Step SM5.

At Step SM5, the CPU 4 stores the output value of the currently generated volume control envelope waveform in the register AECL (NR[TheNR].LOSC[TheLOSC].AECL). The register AECL (NR[TheNR].LOSC[TheLOSC].AECL) is provided within the register LOSC[TheLOSC] specified by the logical oscillator number TheLOSC of the slave oscillator that is not set to always not be in use. The register LOSC

[TheLOSC] is provided within the note parameter register NR[TheNR] specified by the note parameter register number TheNR.

In addition, at Step SM5, the CPU 4 sets a value indicating a progression state of the currently generated volume control envelope waveform ("0" in the stopped state, "1" in the attack area, "2" in the decay area, "3" in the sustain area, and "4" in the release area) in the flag AES (NR[TheNR].LOSC[TheLOSC].AES). The flag AES (NR[TheNR].LOSC[TheLOSC]. AES) is provided within the register LOSC[TheLOSC] specified by the logical oscillator number TheLOSC of the slave oscillator that is not set to always not be in use. The register LOSC[TheLOSC] is provided within the note parameter register NR[TheNR] specified by the note parameter register number TheNR.

Furthermore, at Step SM5, the CPU 4 stores the performance key (the key number of the operated key), stored in the register PK, in a register r1. The register PK is provided within the note parameter register NR[TheNR] specified by the note parameter register number TheNR. The CPU 4 also stores the after-touch table number, stored in the register ATTN, in a register r2. The register ATTN is provided within the register LOSC[TheLOSC] specified by the logical oscillator number TheLOSC. The logical oscillator number TheLOSC is provided within the note parameter register NR[TheNR] specified by the note parameter register number TheNR.

Still further, at Step SM5, the CPU 4 generates an after-touch value ATTBL[r2][r1] corresponding to the performance key in the register r1, with reference to the after-touch table ATTBL[r2] specified by the after-touch table number in the register r2, among the after-touch tables ATTBL stored in the data area of the ROM 6.

Still further, at Step SM5, the CPU 4 adds the after-touch value ATTBL[r2][r1] to the current volume control envelope waveform output value, stored in the register AECL (NR[TheNR].LOSC[TheLOSC].AECL). The register AECL (NR[TheNR].LOSC[TheLOSC].AECL) is provided within the register LOSC[TheLOSC] specified by the logical oscillator number TheLOSC of the slave oscillator that is not set to always not be in use. The register LOSC[TheLOSC] is provided within the note parameter register NR[TheNR] specified by the note parameter register number TheNR. Then, the CPU 4 stores the addition result in a register L. When the value in the register L exceeds "127", the CPU sets the register L to a maximum value "127". At the same time, when the value in the register L is smaller than "0", the CPU sets the register L to a minimum value "0".

Subsequently, the CPU 4 proceeds to Step SM10 shown in FIG. 24 and judges whether the value in the register L is the minimum value "0". Hereinafter, the operations are divided into when the register L is not set to the minimum value "0" and when the register L is set to the minimum value "0" and explained.

<When Value in Register L is not Minimum Value "0">

In this case, the judgment result at Step SM10 is "NO", and the CPU 4 proceeds to Step SM13. At Step SM13, the CPU 4 judges to which among "0", "1", and "2" the flag Use (NR[TheNR].LOSC[TheLOSC].Use), within the register LOSC[TheLOSC] specified by the logical oscillator number TheLOSC is set. The register LOSC[TheLOSC] is provided within the note parameter register NR[TheNR] specified by the note parameter register number TheNR. Hereafter, the operation is divided into when the flag Use is set to "0", "1" and "2", and respectively explained.

a. When flag Use is "0"

When the flag Use is set to "0", a state is indicated in which the slave oscillator of the logical oscillator number TheLOSC loses a position as the physical oscillator due to a new sound production. Furthermore, the slave oscillator is not assigned as the physical oscillator and is not involved in the sound production process. In a physical oscillator re-assignment wait state such as this, the CPU 4 proceeds to Step SM14. After the physical oscillator acquiring flag AsnFlg is set to "2", the CPU 4 performs the physical OSC acquiring process (see FIG. 15 and FIG. 16) described above, via the Step SM16. In the physical OSC acquiring process, as described above, when the physical oscillator acquiring flag AsnFlg is "2", the CPU 4 sets the physical oscillator number as TheOSC, when a physical oscillator is not in use. The CPU 4 sets TheOSC to "−1" when no physical oscillator is not in use.

Subsequently, the CPU 4 performs the OSC parameter setting process (see FIG. 18) via Step SM17. As described above, in the OSC parameter setting process, when the physical oscillator number TheOSC is set to "−1", namely set to the state in which the physical oscillator number TheOSC is not acquired, the CPU 4 completes the present process without performing any operations. In other words, the re-assignment of the physical oscillator is not performed.

At the same time, when the physical oscillator number TheOSC is not set to "−1", the CPU 4 performs the parameter setting to produce the sound of the physical oscillator of the acquired physical oscillator number TheOSC. In addition, the CPU 4 sets the waveform generation mode of the physical oscillator operating as the slave oscillator (the off-set address AdrOfs indicating the difference between the waveform read-out address of the slave oscillator and the waveform read-out address of the master oscillator, the end address EndAdr, and the loop address LoopAdr). As a result, the re-assignment is performed on the physical oscillator that is not in use, and the sound production can be resumed. Then, the CPU4 proceeds to Step SM18. The CPU 4 stores the volume control envelope waveform output value, stored in the register L, in the register TCL (NR[TheNR].LOSC[TheLOSC].TCL). The register TCL (NR[TheNR].LOSC[TheLOSC].TCL) is provided within the register LOSC[TheLOSC] specified by the logical oscillator number TheLOSC. The register LOSC[TheLOSC] is provided within the note parameter register NR[TheNR] specified by the note parameter register number TheNR. Then, the CPU 4 returns to Step SM8 described above (see FIG. 23).

b. When flag Use is "1"

When the flag Use is set to "1", a state is indicated in which the slave oscillator of the logical oscillator number TheLOSC is assigned as the physical oscillator and is being sounded. Envelope formation is also performed. In this case, the CPU 4 proceeds to Step SM18. The CPU 4 stores the volume control envelope waveform output value, stored in the register L, in the register TCL (NR[TheNR].LOSC[TheLOSC].TCL). The register TCL (NR[TheNR].LOSC[TheLOSC].TCL) is provided within the register LOSC[TheLOSC] specified by the logical oscillator number TheLOSC. The register LOSC[TheLOSC] is provided within the note parameter register NR[TheNR] specified by the note parameter register number TheNR. Then, the CPU 4 returns to Step SM8 described above (see FIG. 23).

c. When flag Use is "2"

When the flag Use is set to "2", the physical oscillator assignment wait state immediately after note-ON is indicated. In this case, the CPU proceeds to Step SM15 and sets the physical oscillator acquiring flag AsnFlg to "1". Then, the CPU 4 performs the physical OSC acquiring process described above (see FIG. 15 to FIG. 16), via Step SM16.

As described above, in the physical OSC acquiring process, when the physical oscillator acquiring flag AsnFlg is set to "1", if a physical oscillator is not in use, the physical oscillator number thereof is preferentially set as TheOSC. In addition, when all physical oscillators are used as the master oscillator, TheOSC is set to"−1". Furthermore, when all physical oscillators are in use and a physical oscillator is used as the slave oscillator, the physical oscillator number of the slave oscillator is set as TheOSC. In this case, in the physical OSC release process (see FIG. 17), the CPU 4 stops the sound production of the physical oscillator specified by the physical oscillator number TheOSC of the sound production assignment subject. In accompaniment with the sound production being stopped, the CPU 4 updates the content (the flag Use and the register AON) of the logical oscillator parameters in the note parameter register NR. In correspondence with the update, the CPU 4 changes the contents of the physical/logical oscillator correspondence parameter registers PhOSC (PhOSC[TheOSC].Use) and the contents of the oscillator parameter registers PROSC (PROSC[TheOSC].RUN).

Then, the CPU 4 performs the OSC parameter setting process (see FIG. 18), via Step SM17. As described above, in the OSC parameter setting process, the physical oscillator is not assigned, when the physical oscillator number TheOSC acquired in the physical OSC acquiring process at Step SM16 is set to "−1". At the same time, when TheOSC is not set to "−1", the CPU 4 performs the parameter setting for producing the sound of the physical oscillator. In addition, the CPU 4 sets the waveform generation mode (the off-set address AdrOfs indicating the difference between the waveform read-out address of the slave oscillator and the waveform read-out address of the master oscillator, the end address EndAdr, and the loop address LoopAdr) of the physical oscillator operating as the slave oscillator.

Subsequently, the CPU 4 proceeds to Step SM18. The CPU 4 stores the volume control envelope waveform output value, stored in the register L, in the register TCL (NR[TheNR].LOSC[TheLOSC].TCL). The register TCL (NR[TheNR].LOSC[TheLOSC].TCL) is provided within the register LOSC[TheLOSC] specified by the logical oscillator number TheLOSC. The register LOSC[TheLOSC] is provided within the note parameter register NR[TheNR] specified by the note parameter register number TheNR. Then, the CPU 4 returns to Step SM8 described above (see FIG. 23).

<When Value in Register L is Minimum Value "0">

When the value in the register L is the minimum value "0", the judgment result at Step SM10 described above is "YES", and the CPU 4 proceeds to Step SM11. At Step SM11, the CPU judges whether the logical oscillator number TheLOSC is not set to "0", and the flag Use (NR[TheNR].LOSC[TheLOSC].Use) within the register LOSC[TheLOSC] specified by the logical oscillator number TheLOSC is set to "1". The register LOSC[TheLOSC] is provided within the note parameter register NR[TheNR] specified by the note parameter register number TheNR. In other words, the CPU 4 judges whether the logical oscillator is the slave oscillator that is in use and to which the physical oscillator is assigned.

When the logical oscillator is the master oscillator or the slave oscillator that is in use and to which the physical oscillator is not assigned, the judgment result is "NO", and the CPU 4 proceeds to Step SM18. The CPU 4 stores the volume control envelope waveform output value, stored in the register L, in the register TCL (NR[TheNR].LOSC[TheLOSC].TCL). The register TCL (NR[TheNR]. LOSC[TheLOSC].TCL) is provided within the register LOSC[TheLOSC] specified by the logical oscillator number TheLOSC. The register LOSC[TheLOSC] is provided within the note parameter register NR[TheNR] specified by the note parameter register number TheNR. Then, the CPU 4 returns to Step SM8 described above (see FIG. 23).

At the same time, when the logical oscillator is the slave oscillator that is in use and to which the physical oscillator is assigned, the judgment result at Step SM11 is "YES". The CPU 4 sets the register AON (NR[TheNR].LOSC[TheLOSC].AON), within the register LOSC[TheLOSC] specified by the logical oscillator number TheLOSC, in the physical oscillator number TheOSC. The register LOSC[TheLOSC] is provided within the note parameter register NR[TheNR] specified by the note parameter register number TheNR. Then, the CPU 4 performs the physical OSC release process (see FIG. 17) via Step SM12. The CPU 4 stops the sound production of the physical oscillator of the physical oscillator number TheOSC to be the slave oscillator in use. In addition, in accompaniment with the sound production being stopped, the CPU 4 updates the content (the flag Use and the register AON) of the logical oscillator parameters in the note parameter register NR. In correspondence with the update, the CPU 4 changes the contents of the physical/logical oscillator correspondence parameter registers PhOSC (PhOSC [TheOSC].Use) and the contents of the oscillator parameter registers PROSC (PROSC[TheOSC].RUN).

In other words, in accompaniment with the sound production being stopped due to the volume control envelope waveform output value L reaching "0", the flag Use within the note parameter register NR of the corresponding slave oscillator is set to "0". As a result, the physical oscillators that have been associated with and assigned as the slave oscillators up to this point are released and enter a re-assignment wait state.

Then, the CPU 4 proceeds to Step SM18. The CPU 4 stores the volume control envelope waveform output value, stored in the register L, in the register TCL (NR[TheNR].LOSC[TheLOSC].TCL). The register TCL (NR[TheNR].LOSC[TheLOSC].TCL) is provided within the register LOSC[TheLOSC] specified by the logical oscillator number TheLOSC. The register LOSC[TheLOSC] is provided within the note parameter register NR[TheNR] specified by the note parameter register number TheNR. Then, the CPU 4 returns to Step SM8 described above (see FIG. 23).

B-13. Pitch Envelope Process Operation

Figure 25:
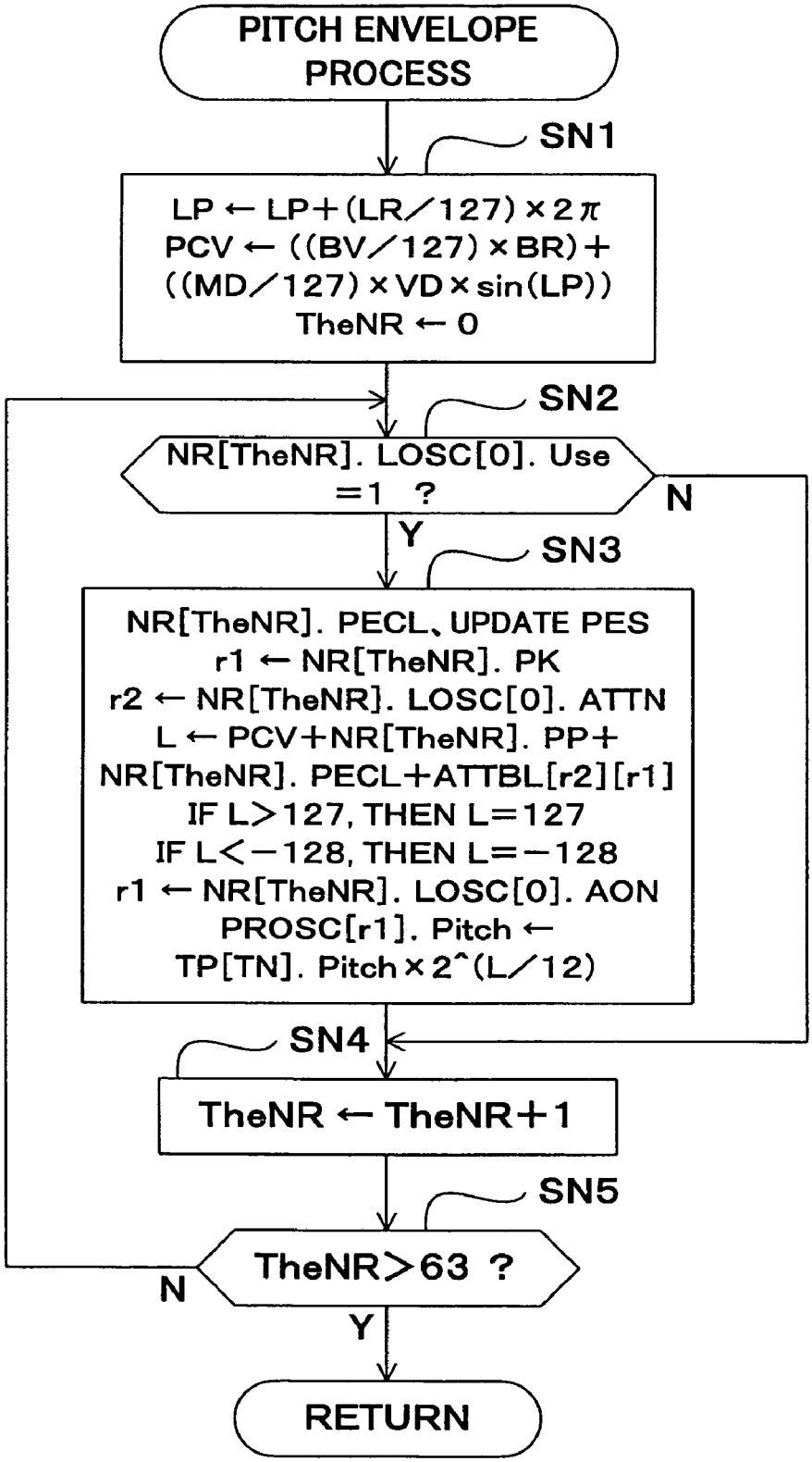
FIG. 25 is a flowchart showing pitch envelope process operations.

Next, the pitch envelope process operation will be explained with reference to FIG. 25. When the present process is performed via Step SK3 of the sound production timer process described above (see FIG. 20), the CPU 4 proceeds to Step SN1 shown in FIG. 25. At Step SN1, the CPU 4 calculates the current LFO phase angle using an equation, $LP+(LR/127)\times 2\pi$, based on the LFO phase angle stored in the register LP and the LFO rate stored in the register LR, within the performance parameter registers. The CPU 4 stores the calculated current LFO phase angle in the register LP.

In addition, at Step SN1, the CPU 4 calculates a pitch control value PCV using an equation, $((BV/127)\times BR)+((MD/127)\times VD\times \sin(LP))$, based on the bender wheel displacement amount stored in the register BV, the bend range setting value stored in the register BR, the modulation wheel displacement amount stored in the register MD, the vibrato depth setting value stored in the register VD, and the current LFO phase angle stored in the register LP, within the performance parameter registers shown in FIG. 6B. The CPU 4 also resets the note parameter register number TheNR to zero.

Next, at Step SN2, the CPU 4 judges whether the master oscillator assigned to the note parameter register NR[TheNR], specified by the note parameter register number TheNR, is in use (NR[TheNR].LOSC[0].Use=1). When the master oscillator assigned to the note parameter register NR[TheNR], specified by the note parameter register number TheNR, is in use, the judgment result is "YES", and the CPU 4 proceeds to Step SN3.

At Step SN3, the CPU 4 stores the output value of the currently generated pitch control envelope waveform in the register PECL (NR[TheNR].PECL). The register PECL (NR[TheNR].PECL) is provided within the note parameter register NR[TheNR] specified by the note parameter register number TheNR. In addition, the CPU 4 sets a value indicating a progression state of the currently generated pitch control envelope waveform ("0" in the stopped state, "1" in the attack area, "2" in the decay area, "3" in the sustain area, and "4" in the release area) in the flag PES (NR[TheNR].PES). The flag PES (NR[TheNR].PES) is provided within the note parameter register NR[TheNR] specified by the note parameter register number TheNR.

In addition, at Step SN3, the CPU 4 stores the performance key (the key number of the operated key), stored in the register PK (NR[TheNR].PK), in the register r1. The register PK (NR[TheNR].PK) is provided within the note parameter register NR[TheNR] specified by the note parameter register number TheNR. The CPU 4 also stores the after-touch table number, stored in the register ATTN, in the register r2. The register ATTN is provided within the register LOSC[0], within the note parameter register NR[TheNR] specified by the note parameter register number TheNR.

Furthermore, at Step SN3, the CPU 4 generates the after-touch value ATTBL[r2][r1] corresponding to the performance key in the register r1, with reference to the after-touch table ATTBL[r2] specified by the after-touch table number, in the register r2, among the after-touch tables ATTBL stored in the data area of the ROM 6.

Still further, at Step SN3, the CPU 4 adds the pitch control value PCV calculated at Step SN1, the pitch displacement (read-out speed) stored in the register PP (NR[TheNR].PP) within the note parameter register NR[TheNR] specified by the note parameter register number TheNR, the pitch control envelope waveform output value stored in the register PECL (NR[TheNR].PECL) within the note parameter register NR[TheNR] specified by the note parameter register number TheNR, and the after-touch value ATTBL[r2][r1]. Then, the CPU 4 stores the addition result in the register L. When the value in the register L exceeds "127", the CPU 4 sets the register L to the maximum value "127". At the same time, when the value in the register L is smaller than "−128", the CPU 4 sets the register L to a minimum value "−128".

Still further, at Step SN3, the CPU 4 stores the physical oscillator number, stored in the register AON within the register LOSC[0], namely the number of the physical oscillator to be used as the master oscillator of the note parameter register NR[TheNR], in the register r1. The register LOSC[0] is provided within the note parameter register NR[TheNR] specified by the note parameter register number TheNR.

Still further, at Step SN3, the CPU 4 generates the waveform read-out phase (read-out pitch) by multiplying the original pitch Pitch (TP[TN].Pitch) by (L/12)-th power of "2". The original pitch Pitch (TP[TN].Pitch) is provided within the tone parameter TP[TN] specified by the tone number TN, selected according to the tone selection switch operations. The CPU 4 stores the generated waveform read-out phase in the register Pitch (PROSC[r1].Pitch) within the oscillator parameter register PROSC[r1], specified by the physical oscillator number stored in the register r1.

Subsequently, the CPU 4 proceeds to Step SN4 and incrementally increases the note parameter register number TheNR by steps. Then, at Step SN5, the CPU 4 judges whether the incremented note parameter register number TheNR exceeds "63". In other words, the CPU 4 judges whether the search for the master oscillator that is in use within the note parameter registers NR[0] to NR[63] is completed. When the search is being performed, the judgment result is "NO", and the CPU 4 returns to Step SN2. At the same time, when the search for the master oscillator that is in use within the note parameter registers NR[0] to NR[63] is completed, the judgment result at Step SN5 is "YES", and the process is completed.

B-14. Accumulating Process Operation

Figure 26:
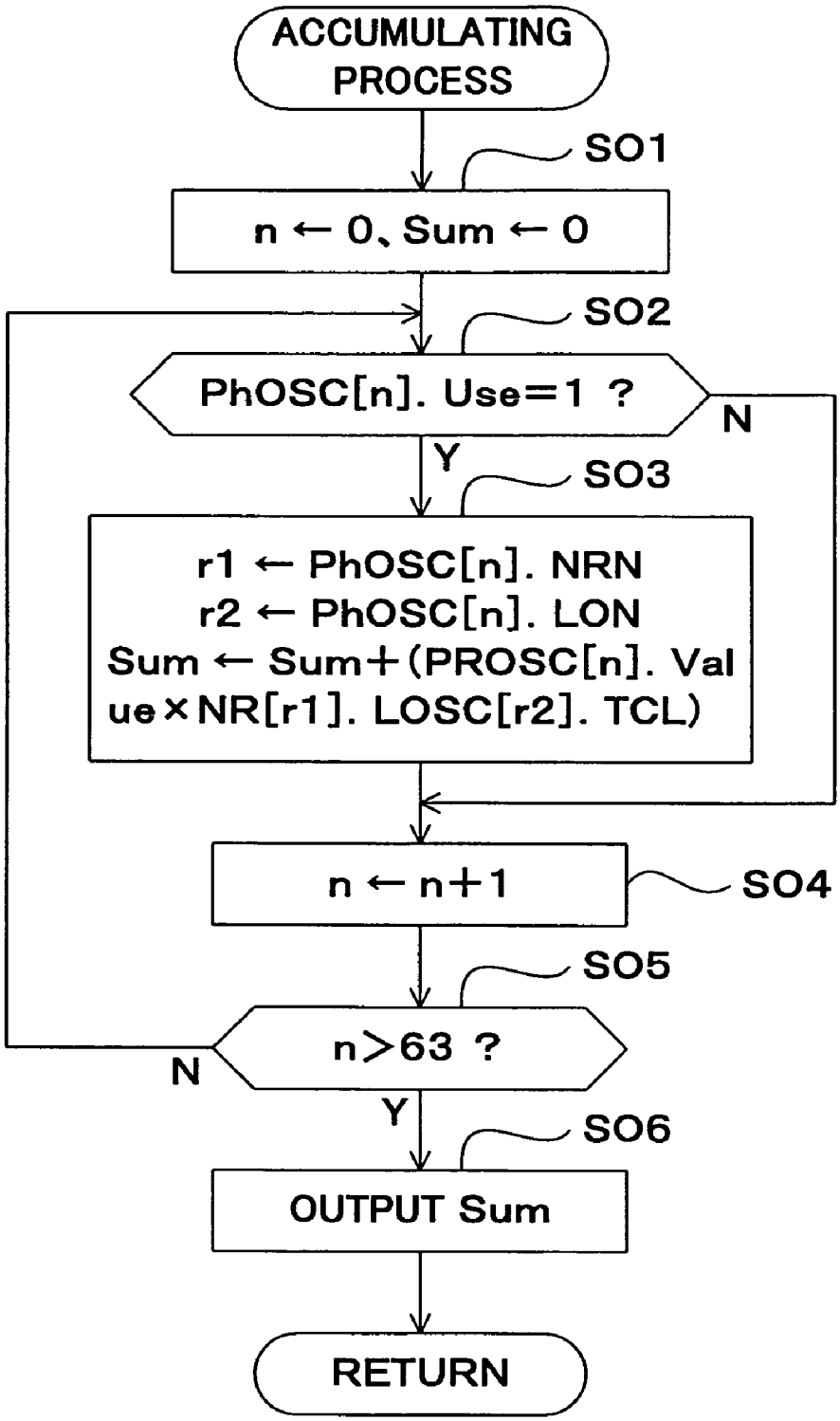
FIG. 26 is a flowchart showing accumulating process operations.

Next, the accumulating process operation is explained with reference to FIG. 26. When the present process is performed via Step SK4 of the sound production timer process described above (see FIG. 20), the CPU 4 proceeds to Step SO1 shown in FIG. 26. The CPU 4 resets the pointer n and the register SUM to zero. Next, at Step SO2, the CPU judges whether the flag Use (PhOSC[n].Use) within the register PhOSC[n] specified by the pointer n, is set to "1". The register PhOSC[n] is provided within the physical/logical oscillator correspondence parameter register shown in FIG. 6A. In other words, the CPU 4 judges whether the physical oscillator specified by the pointer n is in use. If the physical oscillator is not in use, the judgment result is "NO", and the CPU 4 proceeds to Step SO4, described hereafter.

At the same time, when the physical oscillator specified by the pointer n is in use, the judgment result at Step SO2 is "YES", and the CPU 4 proceeds to Step SO3. At Step SO3, the CPU 4 respectively stores the note parameter register number NRN, within the register PhOSC[n] specified by the pointer n, in the register r1 and the logical oscillator number LON, within the register PhOSC[n] specified by the pointer n, in the register r2.

In addition, at Step S03, the CPU 4 multiplies the volume level stored in the register TCL (NR[r1].LOSC[r2].TCL) with the oscillator waveform output value stored in the register Value, within the oscillator parameter register PROSC[n] specified by the pointer n. The register TCL (NR[r1].LOSC[r2].TCL) is provided within the register LOSC[r2] specified by the logical oscillator number LON in the register r2. The register LOSC[r2] is provided within the note parameter register NR[r1] specified by the note parameter register number NRN in the register r1, Then, the CPU 4 accumulates the acquired output waveform value in the register SUM.

Next, at Step SO4, the CPU 4 incrementally increases the pointer n by steps. At the subsequent Step SO5, the CPU 4 judges whether the value of the incremented pointer n exceeds "63". When the value of the pointer n does not exceed "63", the judgment result is "NO", and the CPU 4 returns to Step SO2. The CPU subsequently repeats the Steps SO2 to SO5 until the value of the pointer n exceeds "63". The musical tone waveform is generated by the accumulation of all output waveform values. Then, when the value of the pointer n exceeds "63", the judgment result at Step SO5 is "YES". The CPU 4 performs an output process of the accumulated waveform values in the register Sum at Step SO6 and completes the process.

As explained above, in the present embodiment, the correspondence relationship between the virtual logical oscillators and the plurality of physical oscillators is stored. The virtual logical oscillators include the master oscillator and at least one slave oscillator, provided for each sound production channel that generates the musical tone waveform. The plurality of physical oscillators actually generates the waveform and is associated with the logical oscillator. Then, according to the process of generating the musical tone waveform, the physical oscillator assigned to the logical oscillator of the sound production channel generating the musical tone waveform is dynamically secured or released.

The details of the dynamic securing or releasing of the physical oscillator assigned to the logical oscillator are as follows.

<When Master Oscillator is Assigned During Note-ON>

Any one of the "physical oscillator that is not in use", the "physical oscillator that is being used as the slave oscillator", and the "physical oscillator that is being used as the master oscillator" is selected. The "physical oscillator that is not in use", the "physical oscillator that is being used as the slave oscillator", and the "physical oscillator that is being used as the master oscillator" is the order of priority. When the "physical oscillator that is being used as the slave oscillator" is selected, the CPU 4 stops the sound production of the selected physical oscillator and releases the physical oscillator. When the "physical oscillator that is being used as the master oscillator" is selected, the CPU 4 stops the sound production of the entire channel securing the selected physical oscillator and releases all physical oscillators associated with the logical oscillator (the master oscillator and the logical oscillators) of the sound production channel.

<When Slave Oscillator is Assigned During Note-ON>

The "physical oscillator that is not in use" or the "physical oscillator that is being used as the slave oscillator" is selected. The "physical oscillator that is not in use" and the "physical oscillator that is being used as the slave oscillator" is the order of priority. When the "physical oscillator that is being used as the slave oscillator" is selected, the CPU 4 stops the sound production of the selected physical oscillator and releases the physical oscillator. When all physical oscillators are being used as the master oscillator, no selection is made.

<When Slave Oscillator is Re-assigned During Sound Production>

Only the "physical oscillator that is not in use" is selected. When all physical oscillators are being used as the logical oscillator, no selection is made.

By the physical oscillator assigned to the logical oscillator being dynamically secured or released in this way, there is no need to synchronize and playback all waveforms that may possibly be used in the additive synthesis, regardless of whether the waveform is sounded, as is required conventionally. As a result, the waveforms can be generated without needlessly wasting the sound production channel (oscillator).

In addition, in the present embodiment, according to the tone of the generated musical tone, the waveform read-out address of the master oscillator and the waveform-read-out address of the slave oscillator are off-set in advance. Therefore, even when the slave oscillator is operated while the waveform read-out is being performed on the master oscillator, the slave oscillator generates the waveform by the waveform read-out address of the master oscillator that is modified in correspondence with the off-set. Therefore, a constant amount of phase difference is always maintained between the waveforms to be overlapped. In addition, the pitch modulation by the LFO, pitch events, and the like are always synchronous, and the same modulation width can be continuously provided.

Furthermore, although the computer program product of the waveform generating apparatus which is a preferred embodiment of the present invention is stored in the memory (for example, ROM, etc.) of the waveform generating apparatus, this processing program is stored on a computer-readable medium and should also be protected in the case of manufacturing, selling, etc. of only the program. In that case, the method of protecting the program with a patent will be realized by the form of the computer-readable medium on which the computer program product is stored.

While the present invention has been described with reference to the preferred embodiments, it is intended that the invention be not limited by any of the details of the description therein but includes all the embodiments which fall within the scope of the appended claims.

What is claimed is:

1. A waveform generating apparatus comprising:

virtual logical oscillator means including a master oscillator and at least one slave oscillator, provided for each sound production channel generating a musical tone waveform;

a plurality of physical oscillator means for actually generating a waveform and which is associated with the logical oscillators;

memory means for storing a correspondence relationship between the logical oscillator means and the physical oscillator means; and dynamic assignment means for dynamically securing or releasing the physical oscillator means assigned to the logical oscillator means of the sound production channel generating the musical tone, according to a process for generating the musical tone waveform, with reference to the correspondence relationship stored in the memory means;

wherein the dynamic assignment means selects any one of a "physical oscillator means that is not in use", a "physical oscillator means being used as a slave oscillator", and a "physical oscillator means being used as a master oscillator" according to note-ON, an order of priority being the "physical oscillator means that is not in use", the "physical oscillator means being used as a slave oscillator", and the "physical oscillator means being used as a master oscillator", and assigns the selected physical oscillator means to the master oscillator of the logical oscillator means.

2. The waveform generating apparatus according to claim 1, wherein:

when the "physical oscillator means being used as a slave oscillator" is selected and assigned as the master oscillator of the logical oscillator means, the dynamic assignment means stops and releases the selected physical oscillator means.

3. The waveform generating apparatus according to claim 1, wherein:

when the "physical oscillator means being used as a master oscillator" is selected and assigned as the master oscillator of the logical oscillator means, the dynamic assignment means stops sound production of an entire sound production channel securing the selected physical oscillator means and releases all physical oscillator means associated with the master oscillator and the slave oscillators of the sound production channel.

4. A waveform generating apparatus comprising:

virtual logical oscillator means including a master oscillator and at least one slave oscillator, provided for each sound production channel generating a musical tone waveform;

a plurality of physical oscillator means for actually generating a waveform and which is associated with the logical oscillators;

memory means for storing a correspondence relationship between the logical oscillator means and the physical oscillator means; and dynamic assignment means for dynamically securing or releasing the physical oscillator means assigned to the logical oscillator means of the sound production channel generating the musical tone, according to a process for generating the musical tone waveform, with reference to the correspondence relationship stored in the memory means;

wherein the dynamic assignment means selects a "physical oscillator means that is not in use" or a "physical oscillator means being used as a slave oscillator" according to note-ON, an order of priority being the "physical oscillator means that is not in use" and the "physical oscillator means being used as a slave oscillator", and assigns the selected physical oscillator means to the master oscillator of the logical oscillator means.

5. The waveform generating apparatus according to claim 4, wherein:

when the "physical oscillator means being used as a slave oscillator" is selected and assigned as the master oscillator of the logical oscillator means, the dynamic assignment means stops the sound production of the selected physical oscillator means and releases the selected physical oscillator means.

6. The waveform generating apparatus according to claim 4, wherein:

when all physical oscillator means are being used as the master oscillator, the dynamic assignment means makes no selection.

7. A waveform generating apparatus comprising:

virtual logical oscillator means including a master oscillator and at least one slave oscillator, provided for each sound production channel generating a musical tone waveform;

a plurality of physical oscillator means for actually generating a waveform and which is associated with the logical oscillators;

memory means for storing a correspondence relationship between the logical oscillator means and the physical oscillator means; and dynamic assignment means for dynamically securing or releasing the physical oscillator means assigned to the logical oscillator means of the sound production channel generating the musical tone, according to a process for generating the musical tone waveform, with reference to the correspondence relationship stored in the memory means;

wherein the dynamic assignment means selects only a "physical oscillator means that is not in use" when a slave oscillator is re-assigned during sound production and makes no selection when all physical oscillators are being used as logical oscillators.

* * * * *